United States Patent [19]

Kato et al.

[11] Patent Number: 4,759,393

[45] Date of Patent: Jul. 26, 1988

[54] LOOM

[75] Inventors: Takatsugu Kato, Tokyo; Takao Takahashi, Hachioji, both of Japan

[73] Assignee: Nissan Motor Co., Ltd., Yokohama, Japan

[21] Appl. No.: 701,631

[22] Filed: Feb. 14, 1985

Related U.S. Application Data

[62] Division of Ser. No. 686,702, Dec. 27, 1984, abandoned.

[30] Foreign Application Priority Data

Dec. 28, 1983 [JP] Japan ..... 58-245211
Apr. 6, 1984 [JP] Japan ..... 59-67383

[51] Int. Cl.[4] ..... D03D 47/34; D03D 47/30; D03D 51/00; D03D 51/08

[52] U.S. Cl. ..... 139/452; 139/1 R; 139/1 E; 139/349; 139/370.2; 139/435; 242/47.01

[58] Field of Search ..... 129/452, 370.2, 1 E, 129/435; 139/370.1, 336, 349; 242/47.01, 47.12, 47.13

[56] References Cited

U.S. PATENT DOCUMENTS

| | | | |
|---|---|---|---|
| 4,448,223 | 5/1984 | Deborde et al. | 139/435 |
| 4,458,725 | 7/1984 | Schwarz | 139/1 E |
| 4,465,110 | 8/1984 | Dekker | 139/370.2 |
| 4,503,889 | 3/1985 | Van Mullekom | 139/1 R |
| 4,538,650 | 9/1985 | Kodama et al. | 139/452 |
| 4,566,566 | 1/1986 | Vuillet | 139/1 E |

FOREIGN PATENT DOCUMENTS

| | | |
|---|---|---|
| 3151349 | 7/1982 | Fed. Rep. of Germany . |
| 2497841 | 7/1982 | France . |
| 2527655 | 12/1983 | France . |
| 637706 | 8/1983 | Switzerland . |
| 2119819 | 11/1983 | United Kingdom . |

*Primary Examiner*—Harvey C. Hornsby
*Assistant Examiner*—Joseph S. Machuga
*Attorney, Agent, or Firm*—Foley & Lardner, Schwartz, Jeffery, Schwaab, Mack, Blumenthal & Evans

[57] ABSTRACT

A loom having a drum type weft reservoir including a drum on which a predetermined length of a weft yarn is wound to be measured and reserved prior to weft picking. The weft reservoir is automatically prepared for loom starting by merely operating a manual switch. The local includes a clutch which is engaged at a predetermined operational phase of the loom to drive the weft reservoir. If the manual switch is actuated when the clutch is disengaged, then the clutch is engaged at a second time substantially later than the first time at which the predetermined operational phase is reached. Any cut, broken or unnecessary weft yarn remaining wound on the drum when the switch is actuated is removed during the interval between the first and second times, e.g. by pulling the weft yarn from the side of a weft inserting nozzle. The weft yarn is pulled from the weft inserting nozzle side by a device such as a picked weft yarn removing device adapted to pull the weft yarn wound on the weft reservoir drum in the direction of the weft inserting nozzle. When the second time comes, the weft reservoir is driven and a new weft yarn is wound on the weft reservoir drum for use as the weft yarn when the loom starts. The loom thus is prepared for starting merely by actuating the manual switch, regardless of the number of turns of weft yarn wound on the drum before the switch is actuated.

12 Claims, 21 Drawing Sheets

AIR
MM
IM
B
SV
MV
LS
PS
R

AIR
SV
MV
LS
PS
IM
MM
B
R

LOOM

This is a division of application Ser. No. 686,702, filed Dec. 27, 1984, now abandoned.

BACKGROUND OF THE INVENTION

1. Field of the Invention

This invention relates in general to an improvement in a loom, and more particularly to a device for removing a picked weft yarn from the shed of warp yarns in order to facilitate re-starting of the loom in case of loom stopping due to mispick or failed weft insertion.

2. Description of the Prior Art

In connection with conventional looms, when mispick arises during its operation, a loom stop signal is produced upon detection of the mispick in order to switch off a main motor and apply a brake to a main shaft of the loom, thereby automatically stopping the loom. In this case, the stopping of the loom is usually completed at the beating-up step after the next weft picking is made, since a certain time period is required from the time point of braking the main shaft to the time point of actual loom stopping. Accordingly, in order to re-start the loom, it is necessary to remove a weft yarn picked after the mispick arising in addition to the mispicked weft yarn.

In this regard, a device for removing the weft yarn picked after mispick arising has been hitherto proposed, in which a guide or obstructing plate is projectable of a weft inserting nozzle to obstruct the weft picking by allowing the weft yarn to strike against the guide plate, thereafter the thus obstructed weft yarn is sucked into a suction nozzle to be removed. After loom stopping, a mispicked weft yarn is manually removed upon making a reverse revolution of the loom by an operation angle to enable removal of the mispicked weft yarn.

However, drawbacks have been encountered in such a conventional picked weft yarn removing device in which the weft yarn to be picked from the weft inserting nozzle is obstructed from its advance by the guide plate and then sucked into the suction nozzle. That is, the posture of the weft yarn after striking the guide plate is unsettled, so that there frequently occurs separation of the weft yarn from the suction nozzle thereby making uncertain the suction of the weft yarn into the suction nozzle. In this regard, it has been necessary to strictly set the operation timing of the suction nozzle and the like.

SUMMARY OF THE INVENTION

A loom of the present invention is provided with a member movable together with a reed and formed with a guide space through which a weft yarn projected from a weft inserting nozzle is picked into the shed of warp yarns. The guide space is locatable between the weft inserting nozzle and the warp yarns. An air flow passage is provided to merge in the guide space in such a manner that the weft yarn lying in the guide space is forced into the air flow passage to be removed under the influence of an air stream developed through the guide space. Accordingly, the weft yarn picked prior to loom stopping due to mispick can be surely removed from the warp shed, thereby facilitating re-starting of the loom.

BRIEF DESCRIPTION OF THE DRAWINGS

The features and advantages of the loom according to the present invention will be more clearly appreciated from the following description taken in conjunction with the accompanying drawings in which like reference numerals designate corresponding parts and elements, and in which.

DETAILED DESCRIPTION OF THE INVENTION

Figure 1:
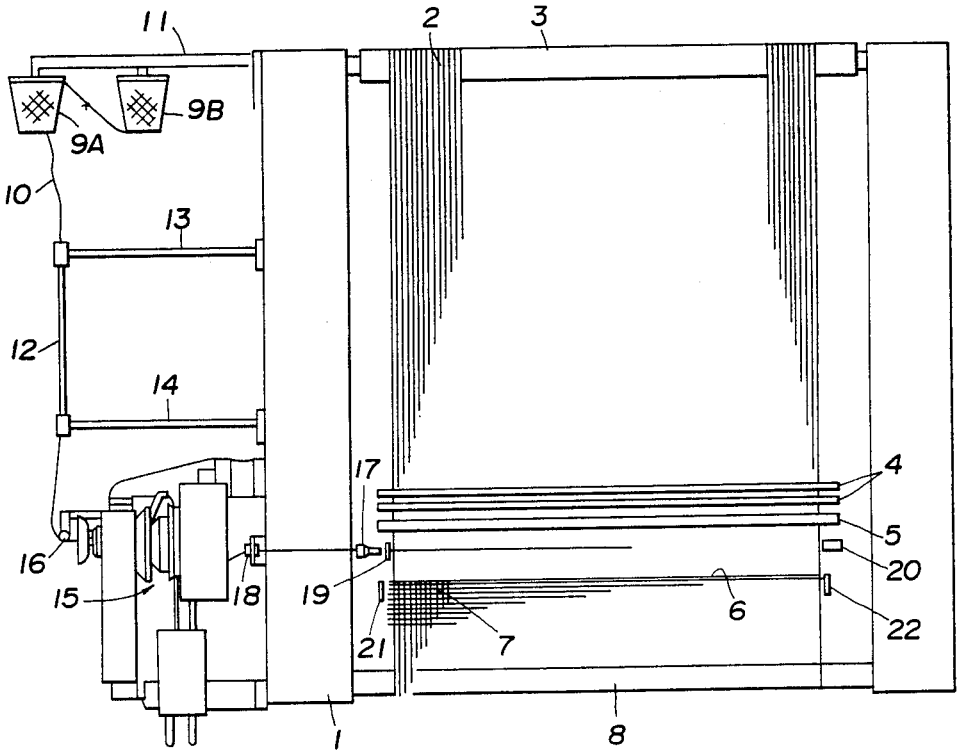
FIG. 1 is a plan view of an embodiment of a loom of the present invention.
Figure 2:
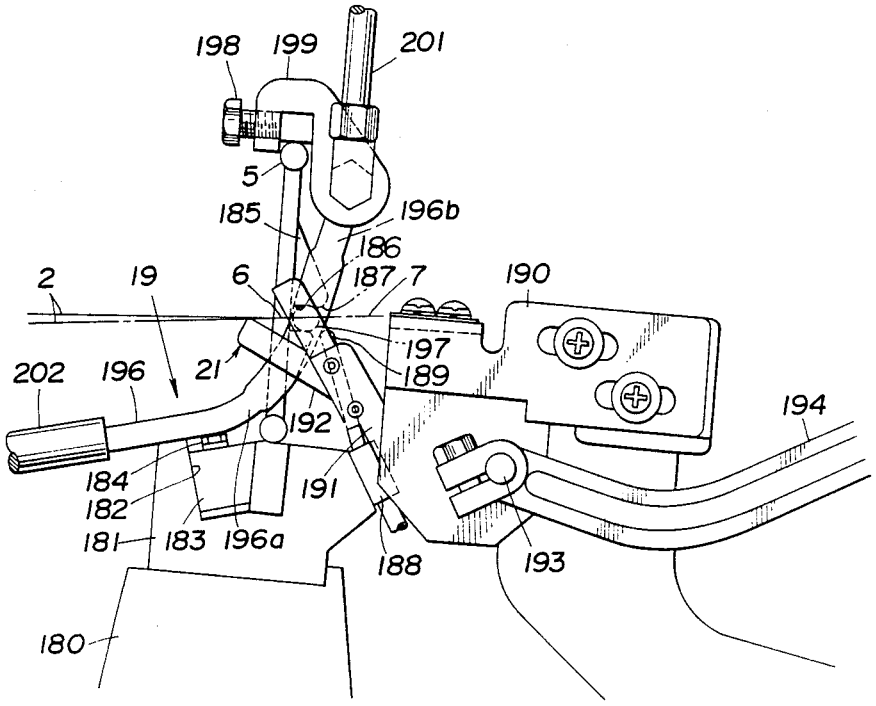
FIG. 2 is a fragmentary side elevation of an example of a picked weft yarn removing device in the loom of FIG. 1.

Referring now to FIG. 1, there is shown an embodiment of a loom in accordance with the present invention, which loom is of the air jet type. The loom consists of a loom frame 1 on which a back roller 3 is rotatably supported, and heads 4 and reed 5 are operatively supported. The reference numeral 2 denotes a plurality of warp yarns which extend through a cloth fell 6 to a woven fabric 7 which is passed on a breast beam 8. Yarn supplies or bobbins 9A, 9B are rotatably supported by a holder 11 attached to the loom frame 1. An air tensor 12 is supported by stays 13, 14 attached to the loom frame 1 and functions to provide tension to a weft yarn 10 supplied from the yarn suppliers 9A, 9B by applying an air stream in a direction opposite to the advancing direction of the weft yarn 10. A drum type weft reservoir or detaining device 15 is provided to measure and detain the weft yarn 10 drawn from the air tensor 12 through a guide pulley 16.

A weft inserting or main nozzle 17 is arranged to insert or pick the weft yarn 10 into the shed of the warp yarns 2 where the weft yarn has been drawn from the weft reservoir 15 through a guide 18. A picked weft yarn removing device 19 is disposed between the weft inserting nozzle 17 and the rows of the warp yarns 2 to remove the picked weft yarn 10 from the shed of the warp yarns 2. A weft end suction device for sucking in an end of the picked weft yarn 10 is disposed on a counter-weft picking side which is opposite to a weft picking side where weft picking is made by the weft inserting nozzle 17, relative to the rows of the warp yarns 2. Cutters 21, 22 are located opposite to each other relative to the rows of the warp yarns 2 to cut the opposite ends of the picked weft yarn 10.

The picked weft yarn removing device 19 will be discussed with reference to FIGS. 2 to 5. A reed holder 181 is fixed on a sley sword 180 at the top section, and formed with a longitudinal groove 182 in which a lower frame of a reed 5 is inserted together with a wedge 183. The wedge 183 is forced into the groove 182 between the wall of the groove 182 and the reed lower frame by screwing in the bolts 184, thereby securing the lower frame of the reed 5 in position. The reed 5 has a plurality of reed blades 185 each of which is formed with a groove or cutout 186 in such a manner that a row of aligned grooves 186 define a weft guide groove or channel 187 (in FIG. 14). The weft inserting nozzle 17 is fixedly mounted on the reed holder 181 at the end section on the weft picking side and directed to the weft guide groove 187. Additionally, a plurality of auxiliary nozzles 189 are installed through support blocks 188 to the reed holder 181 at suitable intervals along the direction of weft insertion. Each auxiliary nozzle 189 is located and adapted to eject an air jet diagonally relative to the weft guide groove 187.

The cutter 21 has a fixed blade 191 which is fixed to a cutter holder 190. A movable blade 192 of the cutter 21 is fixedly mounted on a spindle 193 which is rotataby supported on the cutter holder 190. A drive lever 194 is also fixedly mounted on the spindle 193 and adapted to be driven by a cam (not shown) which rotates in timed relation to a main shaft 252 (in FIG. 14) of the loom. The cutter 21 is disposed so as to be locatable in a space formed by removing reed blades 185 on the weft picking side at beating-up step of the reed, and adapted to execute a cutting action at the beating-up step, more specifically at the initial stage of the return stroke of the reed 5.

Figure 3:
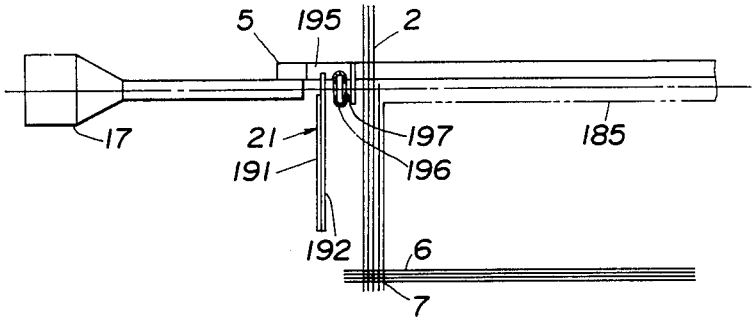
FIG. 3 is fragmentary plan view, partly in section, of the picked weft yarn removing device of FIG. 2.
Figure 4:
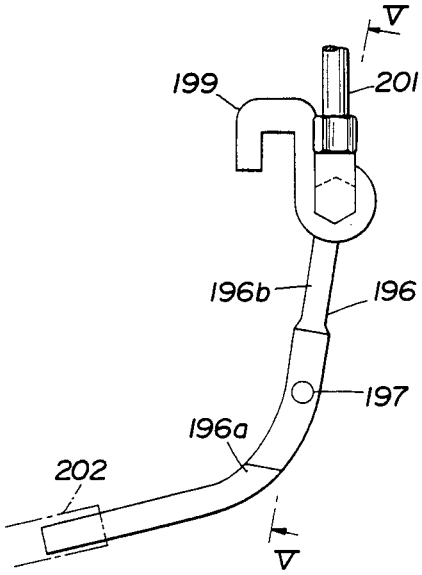
FIG. 4 is a side view of a removing pipe of the picked weft yarn removing device of FIG. 2.
Figure 5:
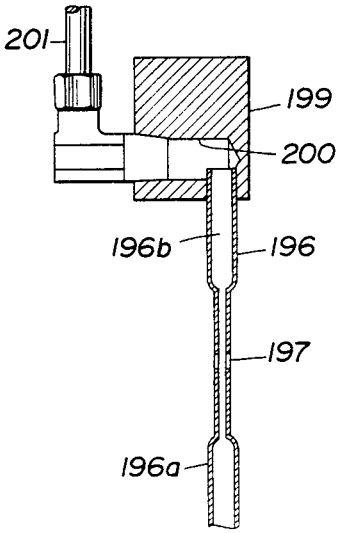
FIG. 5 is a sectional view taken in the direction of arrows substantially along the line V—V of FIG. 4.
Figure 14:
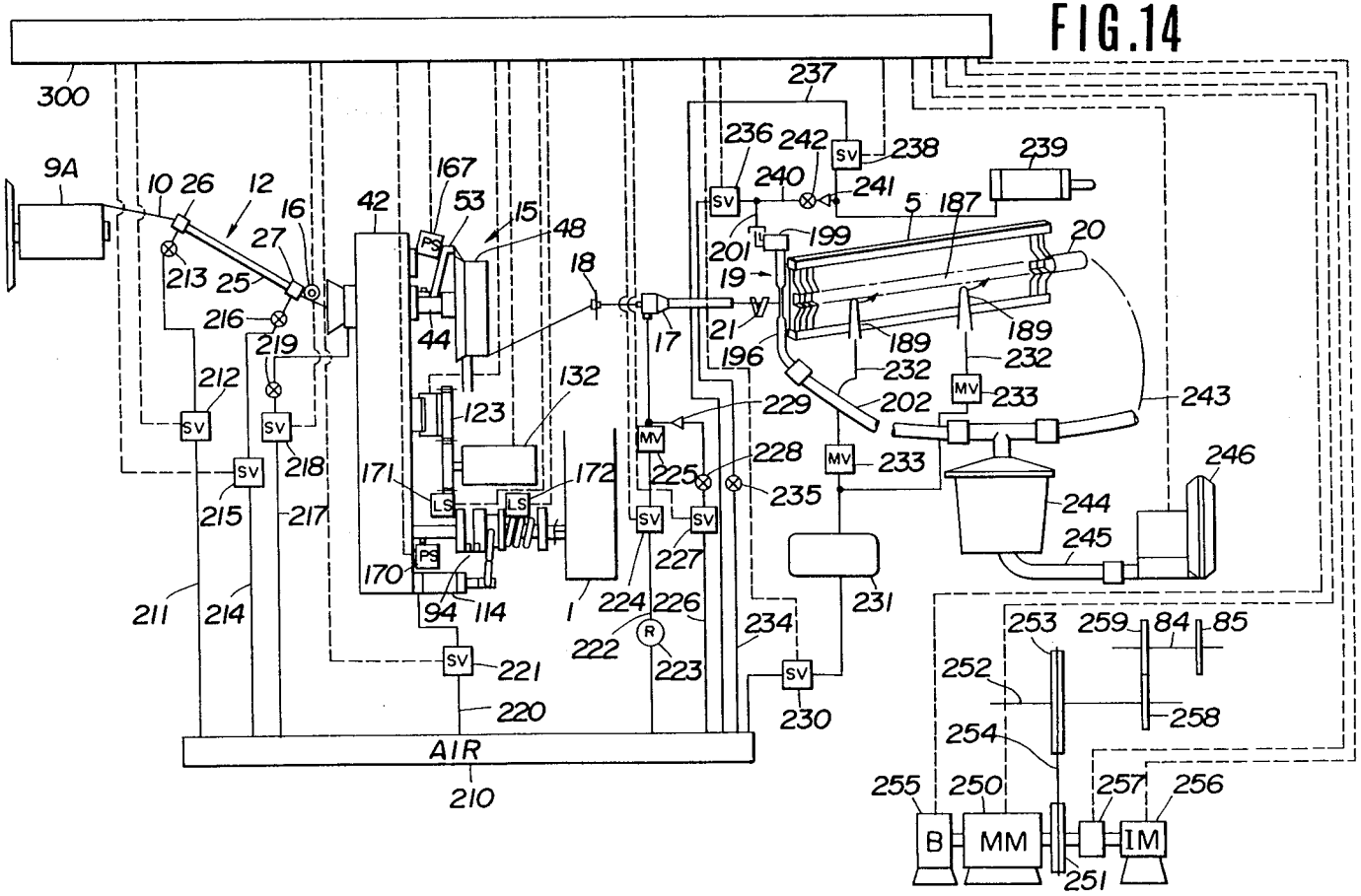
FIG. 14 is a circuit diagram of a control system including air flow and electric circuits, of the loom of FIG. 1.

A pipe or guide member 196 forming part of the picked weft yarn removing device 19 is flattened at its central section having a cross-section as shown in FIG. 3. The flattened central section 196 has opposite parallel walls which are respectively formed at their center portion with two holes 197 whose axes are aligned with each other, the holes form part of a guide space through which the weft yarn 10 passes to be picked. The upper section of the pipe 196 tightly fits in a connecting member 199 which is fixed to the upper frame of the reed 5, thus securing the pipe 196 in position. The pipe 196 is located between the cutter 21 and the rows of the warp yarns 2, and so disposed that the axes of the guide holes 197 are aligned with the axes of the weft inserting nozzle 17 and the weft guide groove 187. The connecting member 199 is formed therein with a communication passage 200 to which a flexible pipe 201 is connected. A pipe 234 leading from a pressurized air supply source 210 is connected to the pipe 201 through a flow amount regulator 235 and a solenoid valve 236 as shown in FIG. 14. Additionally, a flexible pipe 202 is connected to the lower end section of the pipe 196 and connected to the suction port of a blower 246 through a filter 244 and a pipe 245 as shown in FIG. 14. It will be understood that a part of the pipe 196 lower than the guide holes 197 constitutes a downstream pipe section **196*a* (having an air flow passage therein) by which the picked weft yarn 10 is sucked to be removed under the influence of a suction air stream caused by the blower 246, while a part of the pipe 196 above the guide holes 197 constitutes a upstream pipe section 196*b* by which the picked weft yarn 10 extending through and lying in the guide hole 197 is forced into the inlet of the downstream pipe section 196*a*** under the influence of the ejected air stream.

Figure 6:
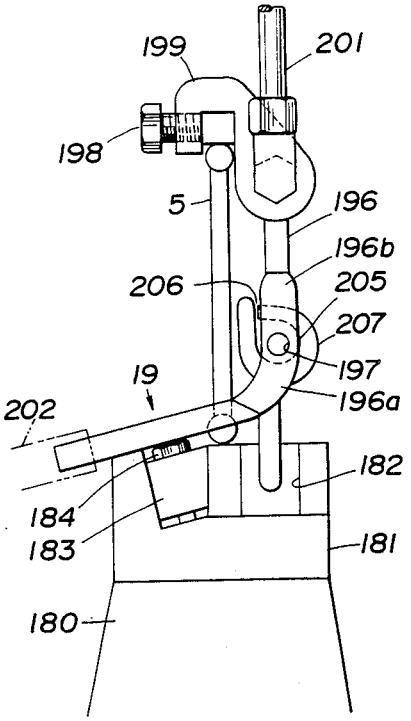
FIG. 6 is a fragmentary side elevation of a modified example of the picked weft yarn removing device.

Otherwise, as shown in FIG. 6, the above-discussed picked weft yarn removing device 19 is applicable to an air jet loom provided with a weft guide device consisting of parallelly aligned air guide members each of which is formed with an air guide opening 205 and a weft yarn escape clearance 206, in which the guide hole 197 of the picked weft yarn removing pipe 196 faces the air guide opening 205.

Figure 7:
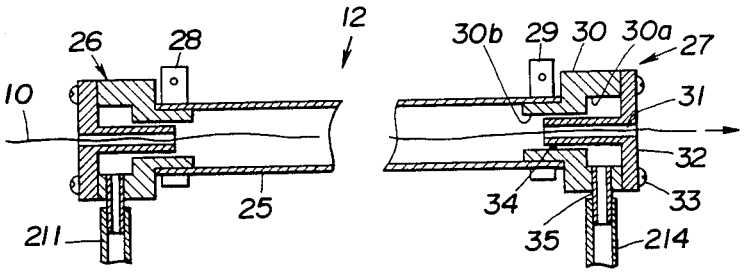
FIG. 7 is a longitudinal sectional view of an air tensor used in the loom of FIG. 1.

The air tensor 12 will be discussed with reference to FIG. 7. The air tensor 12 consists of a transparent pipe 25 having opposite open ends. Air ejection nozzles 26, 27 are provided at the opposite ends of the transparent pipe 25 in such a manner that the tip section of each air ejection nozzle fits in the open end of the pipe 25 and is fastened in position by a band 28, 29. These air ejection nozzles 26, 27 are the same in construction, and accordingly an explanation is made only about the nozzle 27 for the purpose of simplicity of illustration. The nozzle 27 has an outer tube 30 which is constructed of a large diameter section **30*a* and a small diameter section 30*b* both fitting in the pipe 25. As seen in FIG. 7, the small diameter section 30*b* is located on the upstream side of the large diameter section 30*a* relative to the movement of the weft yarn 10 as indicated by an arrow. A yarn introduction pipe 32 is disposed within the outer tube 30 in such a manner that the tip end of the introduction pipe 32 is located within the small diameter section 30*b* of the outer tube 30. The yarn introduction pipe 32 is secured in position by fastening a base plate section (no numeral) of the pipe 32 onto the outer tube large diameter section 30*a* by means of small screws 33. Thus, an annular nozzle opening 34 is defined between the inner surface of the small diameter section 30*b* and the outer surface of the yarn introduction pipe 32. Additionally, the outer tube 30 is securely provided at its large diameter section 30*a* with a connector pipe 35 which opens to the inside of the large diameter section 30*a***.

The air ejection nozzle 26 is provided at the end of the pipe 25 on the inlet side and adapted to eject pressurized air drawn through a pressurized air supply pipe 211 in the same direction as the advancing direction of the weft yarn 10 thereby causing the weft yarn 10 to pass through the pipe 25 for the purpose of setting the weft yarn 10. The air ejection nozzle 27 is provided at the opposite end of the pipe 25 on the outlet side and adapted to always eject pressurized air introduced through a pressurized air supply pipe 214 in the opposite direction to the advancing direction of the weft yarn 10 to provide tension to the weft yarn 10.

Figure 8:
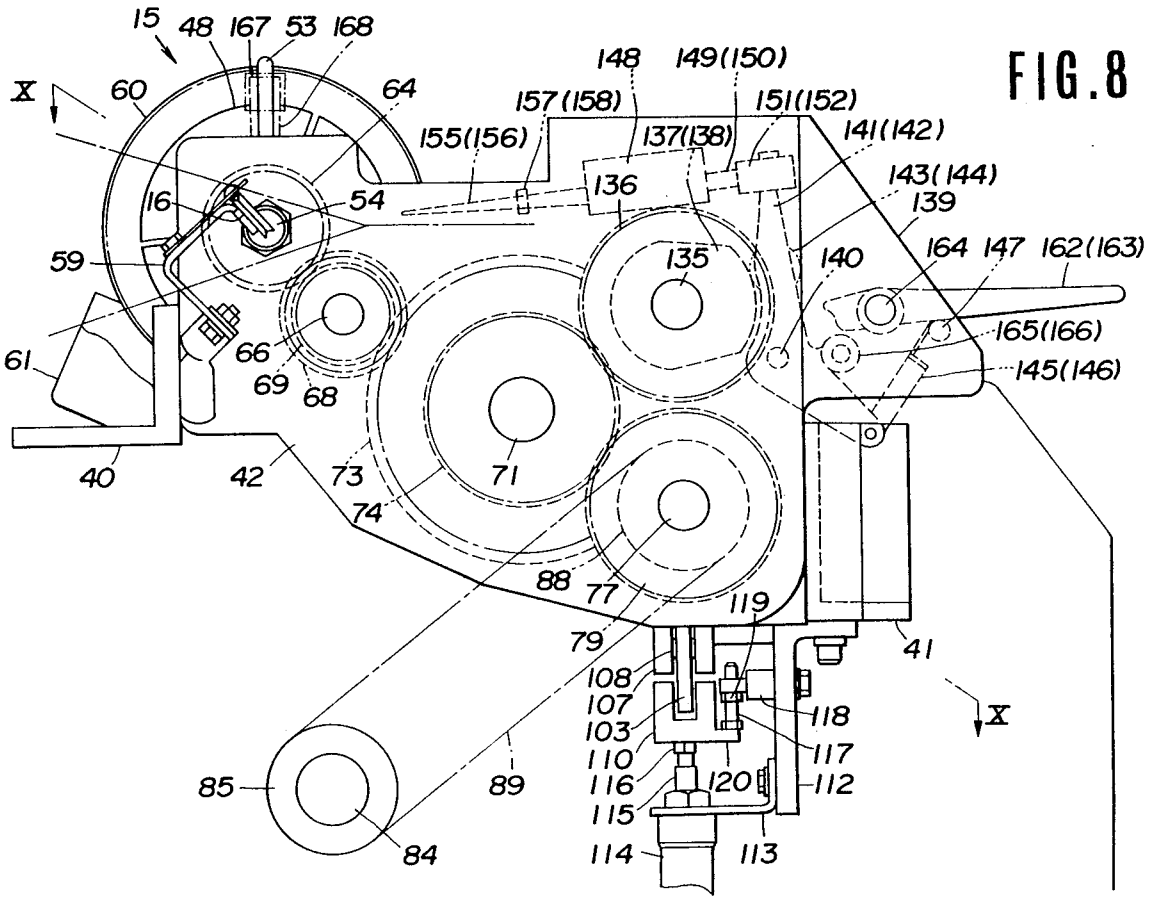
FIG. 8 is a side elevation of a drum type weft reservoir used in the loom of FIG. 1.
Figure 9:
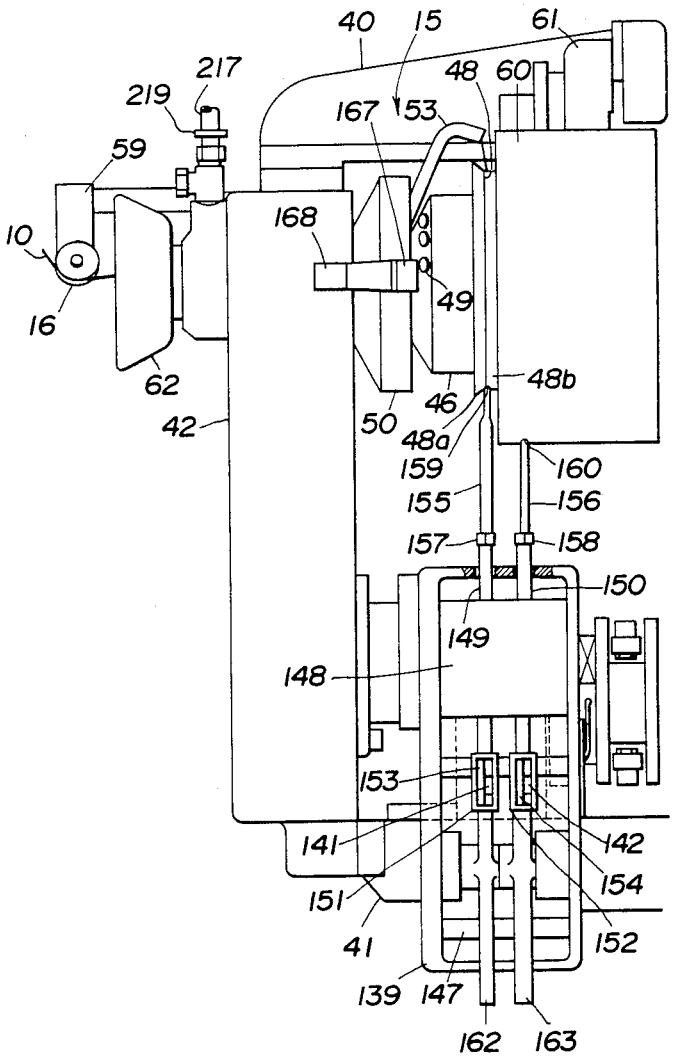
FIG. 9 is a plan view of the weft reservoir of FIG. 8.
Figure 10:
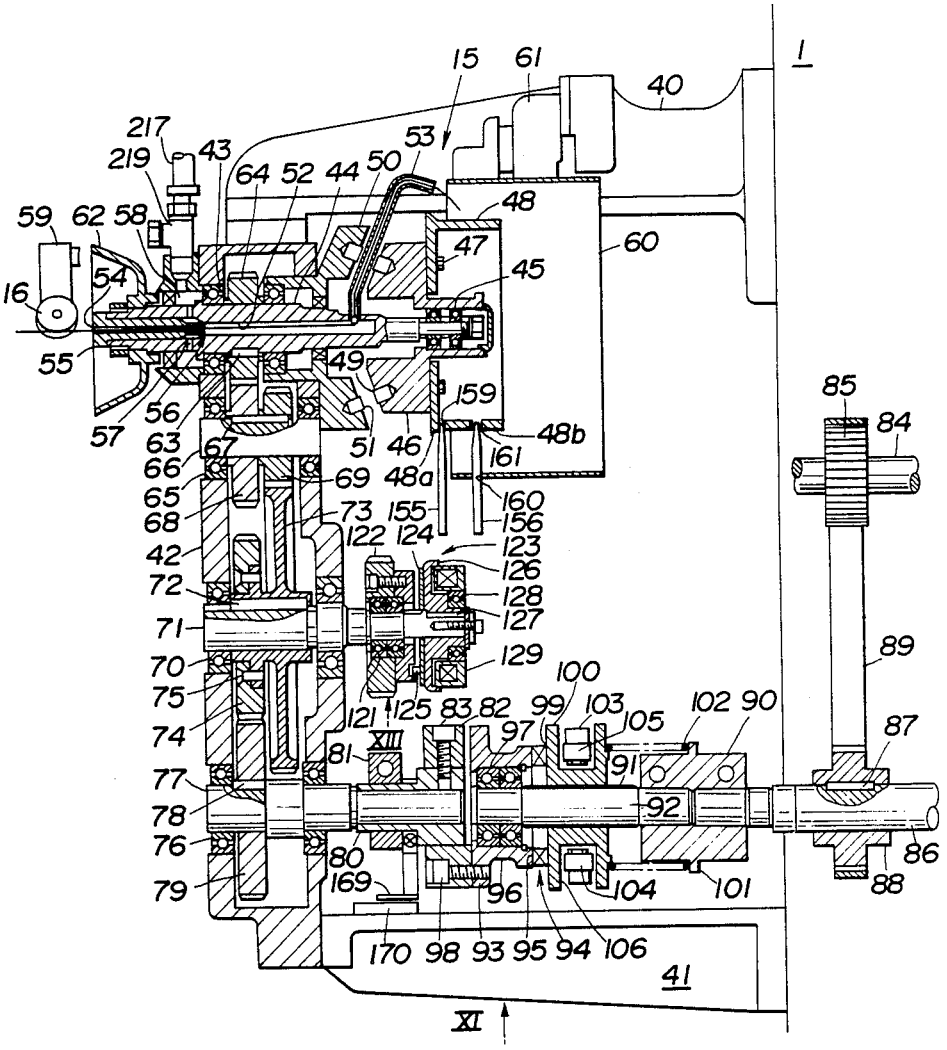
FIG. 10 is a sectional view taken in the direction of arrows substantially along the line X—X of FIG. 8.

The weft reservoir 15 will be discussed with reference to FIGS. 8 to 13. Referring to FIGS. 8 to 10, a gear box 42 of the weft reservoir 15 is attached by brackets 40, 41 to the loom frame 1. A rotatable shaft 44 is rotatably supported through a bearing 43 on the gear box 42. The rotatable shaft 44 is provided at its top end section with a stationary support member 46 which is supported through a bearing 45 on the rotatable shaft 44. A generally cylindrical drum 48 is secured to the stationary support member 46 in such a manner that the axis thereof is aligned with the axis of the rotatable shaft 44. A plurality of permanent magnets 49 are fixedly disposed on the stationary support member 46. Additionally, a plurality of permanent magnets 51 are fixedly disposed on a fixed support member 50 and located so as to face toward the permanent magnets 49 of the stationary support member 46, respectively. Each magnet 49 and each magnet 51 have different Poles from each other, so that the magnetic attraction developed therebetween keeps the support member 46 and accordingly the drum 48 stationary.

The rotatable shaft 44 is formed along its axis with an elongate weft introduction hole 52 which is opened at its front end (on a base section side) and closed at its rear end close to the drum 48. A hollow weft guide pipe 53 is fixed to the rotational shaft 44 in such a manner that the hollow thereof is in communication with the weft introduction hole 52 of the rotatable shaft 44. The weft guide pipe 53 is adapted to rotate around the axis of the rotational shaft 44. Upon rotation of the rotatable shaft 44, the weft guide pipe 53 rotatably passes through a space between the oppositely located permanent magnets 49 and 51. The tip end of the weft guide pipe 53 is bent toward the surface of the drum 48. Secured at the rear end section of the rotatable shaft 44 is a weft introduction pipe 55 whose axial opening 54 is in communication with the weft introduction hole 52 of the shaft 44. It is to be noted that the rear or tip end of the weft introduction pipe 55 is made slender to form a nozzle opening 56 between it and the wall surface of the weft introduction hole 52 through which nozzle opening pressurized air is ejected to cause the weft yarn 10 to pass into the weft introduction hole 52 for the purpose of setting the weft yarn 10. The nozzle opening 56 forms part of an annular space (no numeral) formed around the slender front end of the weft introduction pipe 55, which annular space communicates with an air chamber 58 through communication holes 57 formed radially in the rotatable shaft 44. The air chamber 58 is formed around the rotatable shaft 44 and supplied with pressurized air through a pressurized air supply pipe 217. A flow amount regulator valve 219 is disposed in the pipe 217 to regulate the flow amount of the pressurized air flowing through the pipe 217. A guide pulley 16 is located in the vicinity of the inlet side or front end of the weft introduction pipe 55 and rotatably supported by a stay 59 fixed to the gear box 42. Additionally, a ballooning cover 60 is disposed around the drum 48 to preventing excessive ballooning of the weft yarn 10 to be drawn out from the drum 48. The cover 60 is fixed through a stay 61 to the bracket 40.

A manually rotatable wheel 62 is fixedly mounted on the rotatable shaft 44 to manually cause the rotatable shaft 44 to rotate. In addition, a gear 64 is fixedly mounted on the rotatable shaft 44 by means of a key 63. Two gears 68, 69 are fixedly mounted on a shaft 66 by means of a common key 67 which shaft is rotatably supported through bearings 65 on the gear box 42. The gear 68 is in engagement with the gear 64 mounted on the rotatable shaft 44. The gear 69 is in engagement with a gear 73 which is fixedly mounted on a shaft 71 by means of a key 72. Shaft 71 is rotatably supported through bearings 70 on the gear box 42. Additionally, a gear 74 is fixed to an extended section of the gear 73 by means of bolts 75 and located spacedly parallel with the main body of the gear 73. The gear 74 is in engagement with a gear 79 which is fixedly mounted on a shaft 77 by means of a key 78 which shaft 77 is rotatably supported through bearings 76 on the gear box 42. A hollow shaft 80 is formed at a part thereof with a slit and is mounted on an end section of the shaft 77 and fixed in position by means of a fastening member 81 which is adapted to fasten the hollow shaft in an embracing manner. A ring 82 fits on the hollow shaft 80 and is secured in position by means of a bolt 83.

A drive shaft 84 is driven by the main shaft 252 (in FIG. 14). A toothed pulley 85 is fixedly mounted on the drive shaft 84. A cogged belt 89 is passed around the toothed pulley 85 and a toothed pulley 87 to drivingly connect them. The toothed pulley 88 is fixedly mounted on a shaft 86 by means of a key 87 which shaft 86 is rotatably supported by the loom frame 1. The shaft 86 is fixedly provided at its projected end section with a coupling 90 through which an end section of a shaft 92, provided at its central section with splines 91, is fixedly connected to the shaft 86. A connector 96 is rotatably mounted through a bearing 97 on the other end section of the shaft 92, and formed at one end thereof with a flange 93 and provided at the other end thereof with a one-side counterpart tooth (or a depression) 95, of a engaging clutch 94 which is adapted to be engaged only at a certain phase. The flange 93 is fixed to the ring 82 by bolts 98 as a single member. Fitted to the splines 91 at the central section of the shaft 92 is a change-over member 100 which is axially slidably movable and fixed to the shaft 92. The change-over member 100 serves as a single member in the rotational direction. The change-over member 100 is formed with an other-side counterpart tooth (or a projection) 99 of the engaging clutch 94 which tooth is engageable with the tooth 95. The change-over member 100 is biased leftward in FIG. 10 under the action of a compressed spring 102 interposed between it and the flange 101 of the coupling 102, thereby allowing the clutch 94 to engage.

Figure 11:
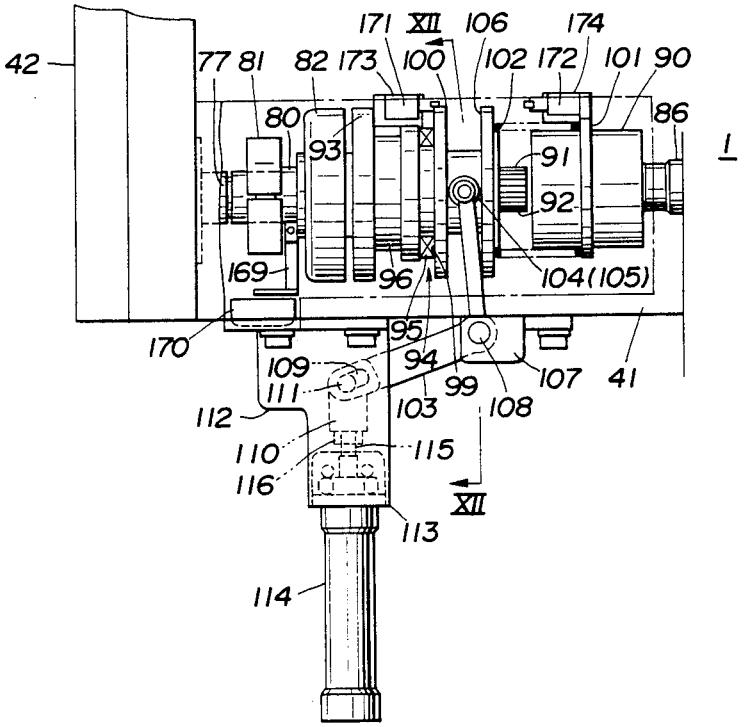
FIG. 11 is a view taken in the direction of an arrow XI of FIG. 10.
Figure 12:
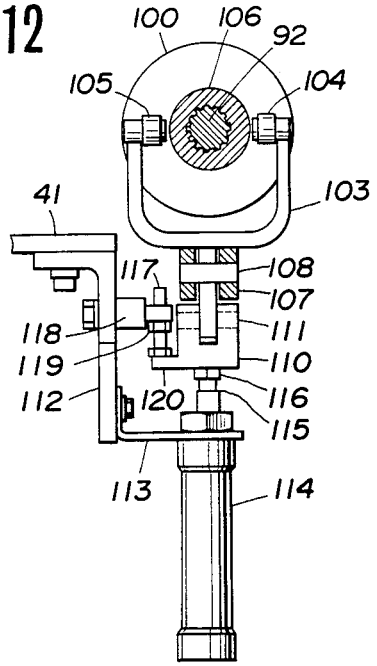
FIG. 12 is a sectional view taken in the direction of arrows substantially along the line XII—XII of FIG. 11.

A change-over lever 103 has at one end a bifurcated section provided with rollers 104, 105 which are inserted into a peripheral annular groove 106 of the change-over member 100. Referring to FIGS. 11 and 12, the change-over lever 103 is rotatably mounted on a spindle 108 of a bearing 107 fixed to the bracket 41. Change-over lever 103 is formed at the other end thereof with an elongated hole 109 in which a pin 111 formed with a receiver member 110 is fitted. The receiver member 110 is threadedly connected to the tip end of a piston rod 115 of an actuator 114 which is fixed to the bracket 41 though a bracket 112 and a stay 113, and fixed in position by means of a lock nut 116. The reference numeral 117 denotes a bolt which is threadedly connected to a stay 118 and fixed in position by means of a lock nut 119. Bolt 117 is adapted to be brought into contact with a projecting section 120 of the receiver member 110 to restrict the movement of the piston rod 115 during the projection of the piston rod 115 (when the engaging clutch 94 is disengaged).

Figure 13:
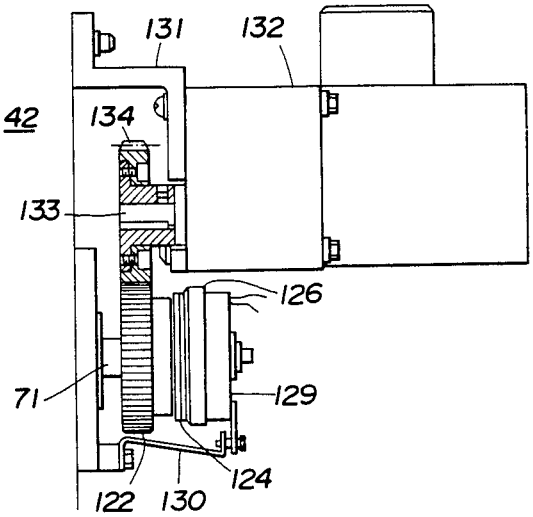
FIG. 13 is a view taken in the direction of an arrow XIII of FIG. 10.

On the shaft 71, a gear 122 is rotatably mounted and additionally an attraction plate 124 of an electromagnetic clutch 123 is loosely fitted. The gear 122 and the attraction plate 124 are always engaged with each other in the rotational direction by means of a pin 125. A friction plate 126 is fixedly mounted on the shaft 71 by means of a key 127 and is located facing the attraction plate 124. Additionally, an electromagnet 129 is rotatably mounted through a bearing 128 on the shaft 71. The electromagnet 129 is fixed through a stay 130 to the gear box 42 so as to prevent rotation of electromagnet 124, and is located opposite the attraction plate 124. The friction plate 126 is interposed between electromagnet 129 and attraction plate 124 as shown in FIG. 13. The gear 122 is in engagement with a gear 134 fixedly mounted on an output shaft 133 of a small-size motor 132 for weft winding which motor is fixed through a bracket 131 to the gear box 42 as shown in FIG. 13.

The gear 74 of the shaft 71 is in engagement with a gear 136 fixedly mounted on a shaft 135 which is rotatably supported by the gear box 42 as shown in FIG. 8, so that the shaft 135 is adapted to be drivable to rotate. Cams 137, 138 are fixedly mounted on the shaft 135. A bracket 138 fixed to the gear box 42 fixedly carries a fixed spindle 140 on which levers 141, 142 are rotatably mounted. Cam rollers 143, 144 are rotatably fixed to the levers 141, 142, respectively. The levers 141, 142 are biased counterclockwise in FIG. 8 under the action of tension springs 145, 146 which have one end connected to the levers 141, 142, thereby allowing the cam rollers 143, 144 to contact with the cams 137, 138, respectively. The other ends of the springs 145, 146 are connected to a stud 147 projecting from the bracket 139 which stud serves also as a stopper for release levers 162, 163 which will be discussed hereinafter.

The bracket 139 fixedly carries a holder 148 in which sliding rods 149, 150 are slidably disposed to be passed through the holder 148. The sliding rods 149, 150 are fixedly provided at their one end with drive frames 151, 152, respectively. Inserted into the drive frames 151, 152 are tip end portions of the levers 141, 142, which tip end portions are provided with rollers 153, 154, respectively, in contact with the inner surface of the drive frames 151, 152. Accordingly, the sliding rods 149, 152 are axially reciprocally movable at predetermined timings under the action of the cams 137, 138. Engaging pins 155, 156 are inserted into the tip end sections of the sliding members 149, 150, respectively, are fixed in position by means of lock nuts 157, 158. Thus, upon reciprocal movement of the sliding rods 149, 150, the engaging pin 155 can be inserted into or withdrawn from a hole 159 formed at the border section between a tapered or frustoconical section **48*a* and a straight or cylindrical section 48*b* of the drum 48, whereas the engaging pin 156 can be inserted into or withdrawn from a hole 161 formed in the straight section 48*b* of the drum 48, passing through a through-hole 160 formed in the ballooning cover 60**.

The release levers 162, 163 are rotatably mounted on a shaft 164 fixed to the bracket 139 and have their tip end sections facing rollers 165, 166 which are movably fixed to the middle sections of the levers 141, 142, respectively. Accordingly, when the release levers 162, 163 are manually operated counterclockwise in FIG. 8, the left end section of lever 162(163) moves downward and pushes roller 165(166) down. This causes the levers 141, 142 to rotate clockwise thereby to withdraw the engaging pins 155, 156 from the holes 159, 161 of the drum 48. Consequently, rotation of the rotatable shaft 44 and the weft guide pipe 53, and operation of the engaging pins 155, 156 are usually effected by the drive shaft 84 via the engaging clutch 123; however, it is arranged that the same rotation and operation can be effected by operating the motor 132 for weft winding upon changing-over the engaging clutch 94 to a disengaged state and engaging the electromagnetic clutch 123. As shown in FIGS. 8 and 9, a proximity switch 167 is fixed through a bracket 168 to the gear box 42 and adapted to detect when the weft guide pipe 53 comes into a location immediately above the proximity switch 167.

As shown in FIGS. 10 and 11, an iron piece 169 is fastened to the hollow shaft 80 in such a manner to embrace the hollow shaft 80. A proximity switch 170 is disposed in the vicinity of the iron piece 169 and fixed to the bracket 41, and adapted to detect the approach of the iron piece 169 thereto. It is to be noted that the iron piece 169 and the proximity switch 170 are brought into close proximity to each other or face each other at 300 degrees in rotational angle of the main shaft 252 (in FIG. 14), the rotational angle being 0 degree at the beating-up stage. As shown in FIG. 11, limit switches 171, 172 are fixed to the bracket 41 through brackets 173, 174, respectively, and located on opposite sides of the change-over member 100. The limit switch 171 is adapted to be switched on only in a state in which the engaging clutch 94 is engaged, whereas the limit switch 172 is adapted to be switched on only in a state in which the engaging clutch 94 is disengaged.

An air supply system will be discussed mainly with reference to FIG. 14. The air ejection nozzle 26 for weft introduction purposes of the air tensor 12 is arranged to be supplied with pressurized air from the pressurized air source 210 through the pipe 211 via a solenoid valve 212 and a flow amount regulator valve 213. The air ejection nozzle 27 for tension providing purposes is arranged to be supplied with air from the pressurized air source 210 through the pipe 214 via a solenoid valve 215 and a flow amount regulator valve 216. It is to be noted that the valves 215, 216 are adjusted so that the amount of air flow to be supplied to the air ejection nozzle 26 is larger than that to the air ejection nozzle 27. The air chamber 58 (in FIG. 10) leading to the nozzle opening 56 (for weft introduction purposes) of the weft reservoir 15 is supplied with pressurized air from the pressurized air source 210 through a pipe 217 via a solenoid valve 218 and a flow amount regulator valve 219. The air actuator 94 for change-over of the engaging clutch 94 is supplied with pressurized air from the pressurized air supply source 210 through the pipe 220 via a solenoid valve 221. It is to be noted that the solenoid valve 221 is adapted to release air from the side of the actuator 114 to atmospheric air in its closed state.

Connected to the weft inserting nozzle 17 is a pipe 222 which leads from the pressurized air supply source 210 and is provided with a regulator 223, a solenoid valve 224 and a mechanical valve 225. The mechanical valve 225 is adapted to open at a predetermined rotational angle of the loom main shaft 252. Additionally, another pipe 226 leading from the pressurized air supply source 210 and provided with a solenoid valve 227, a flow amount regulator valve 228, and a check valve 229 are provided in parallel with a portion of the pipe provided with the regulator 223, the solenoid valve 224, and the mechanical valve 225 pipe 226 is connected to the pipe 222 upstream of the mechanical valve 225.

The auxiliary nozzles 189 are connected through a mechanical valve 233 to an air tank 231 (for the auxiliary nozzles 189) which is in turn connected through a solenoid valve 230 to the pressurized air supply source 210. The mechanical valve 233 is used for each auxiliary nozzle 189 or for a group of auxiliary nozzles 189, and adapted to open at a predetermined rotational angle of the loom main shaft 252.

To the pipe 201, connected through the connector 199 to the removing pipe 196 of the picked weft yarn removing device 19, the pipe 234 leading from the pressurized air supply source 210 and provided with the flow amount regulator valve 235 and the solenoid valve 236 is connected. Connected additionally to the pipe 201 is a pipe 240 which is provided with a check valve 241 and a flow amount regulator valve 242. Pipe 240 is branched off from an air supply line through which pressurized air is supplied to an air actuator 239 for providing tension to the warp yarns 2, the pressurized air being fed to the air supply line from the pressurized air supply source 210 through a pipe 237 via a solenoid valve 238. The lower end section of the removing pipe 196 and the weft end suction device 20 on the counter-weft picking side are connected respectively through the pipes 202, 243 to the suction port of the blower 246 through the filter 244 and the pipe 245.

A driving system of the loom will be discussed with reference to FIG. 14. The driving system consists of a main motor 250 which has an output shaft on which a pulley 251 is fixedly mounted. A belt 254 is passed around the pulley 251 and a pulley 253 fixedly mounted on the main shaft 252 to drivingly connect them, so that the main shaft 252 is driven by the main motor 250. An electromagnetic brake 255 is connected to the output shaft of the main motor 250 and adapted to brake the main shaft 252. A small-size motor 256 for inching purposes has an output shaft which is connected through an electromagnetic clutch 257 to the pulley 251 in order to drive the main shaft 252 at a low speed. A gear 258 is fixedly mounted on the main shaft 252 in engagement with a gear 259 fixedly mounted on the drive shaft 84 thereby to drive the drive shaft 84.

A controller 300 is comprised of a microcomputer and is electrically connected to the solenoid valves 212, 215, 218, 221, 224, 227, 230, 236, 238, the electromagnetic clutch 123, the weft winding motor 132, the blower 246, the main motor 250, the electromagnetic brake 255, the inching motor 256, the electromagnetic switch 257, the proximity switches 167, 170 and the limit switches 171, 172.

Figure 15:
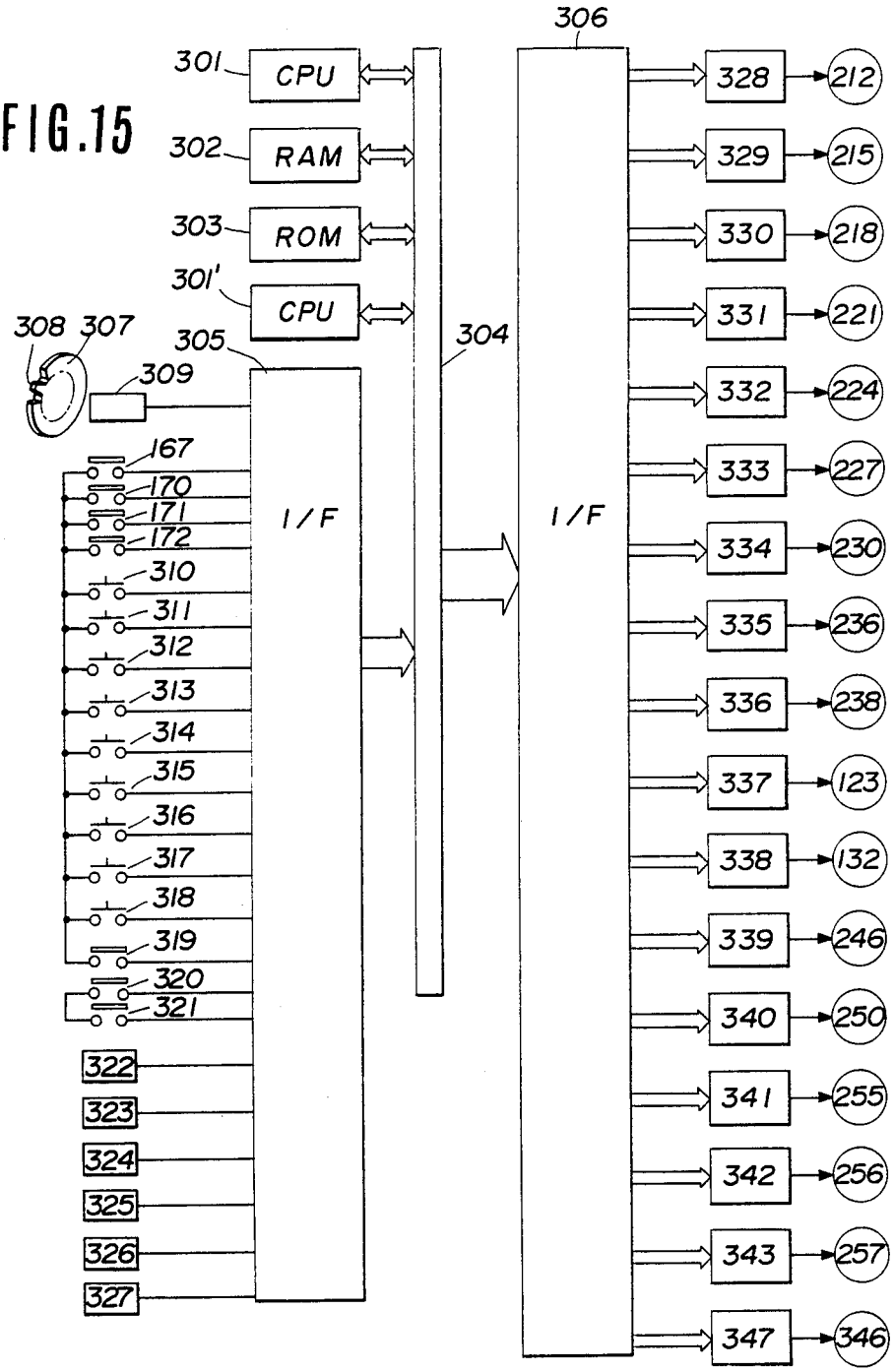
FIG. 15 is a block diagram showing a hardware arrangement for the control system of FIG. 14.

The controller 300 will be discussed with reference to FIG. 15. The controller 300 includes a CPU 301, a RAM 302, a ROM 303, a bus line 304, an interface 305 for input, and an interface 306 for output. The reference numeral 307 denotes a rotatable disc which is rotatable in timed relation to the loom main shaft 252 and formed at its periphery with projections 308 which are located at intervals of an angle of 1 degree. An angle sensor 309 is provided to output an angle signal representing the angle corresponding to the projection 308 upon facing to the projection 308. The angle signal from the angle sensor 309 is input through the input interface 305 into the controller 300. Additionally, also input through the input interface 305 are signals from a switch 310 for preparation of starting the loom, a switch 311 for operating the loom, a switch 312 for stopping the loom, a switch 313 for reverse rotation inching, a switch 314 for normal rotation inching, a switch 315 for reverse rotation inching by one cycle in loom operation, a starting position setting switch 316 for setting the phase or angular position of the loom main shaft 252 at a starting position, a manually operated weft winding switch 317 for accomplishing weft winding on the drum 48 to set the phase or angular position of an operative member of the weft reservor 15 at a starting position, a clutch disengaging switch 318 for disengaging the clutch 94 during the manual operation of the loom, a weft introduction switch 319 for introducing the weft yarn into the air sensor 12, the weft reservoir 15, and the weft inserting nozzle 17. It is to be noted that the weft introduction switch 319 is of the automatically restorable foot operated type whereas the other switches are of the automatically restorable push button type.

A weft feeler 320 is provided to detect mispick and failed weft picking. Additionally, a warp feeler 321 is provided to detect cutting of warp yarns. The signals from these feelers 320, 321 are also input through the input interface 305 to the controller 300. Presetters 322, 323, 324, 325, 326, 327 are provided to preset a variety of angles and times in loom operation, the signals from these presetters being input through the input interface 305 into the controller 300. It will be understood that the signals from the proximity switches 167, 170, and the limit switches 171, 172 are also input through the input interface 305 into the controller 300.

Drivers 328, 329, 330, 331, 332, 333, 334, 335, 336 are provided to drive solenoid valves 212, 215, 218, 221, 224, 227, 230, 236, 238, respectively. Additionally, drivers 337, 338, 339, 340, 341, 342, 343 are provided to drive the electromagnetic clutch 123, the weft winding motor 132, the blower 246, the main motor 250, the electromagnetic brake 255, the inching motor 256, and the electromagnetic clutch 257. These drivers 328-343 are electrically connected to the output interface 306.

In addition, a lamp 346 is provided to indicate the operation of the loom. The reference numeral 347 denotes a driver for driving the lamp 346, which driver is also electrically connected to the output interface 306. p The manner of operation of the above-described loom will be discussed hereinafter with reference to the flow charts of FIGS. 16A and 16B.

In starting the loom, when the loom is in condition for starting in which a predetermined length of the weft yarn 10 is wound on the drum 48, the starting preparation switch 310 is first closed. Then, the blower 246 is driven. Subsequently, the electromagnetic clutch 257 is switched off (or disengaged) to disconnect the output shaft of the main motor 250 and that of the inching motor 256. Next, the solenoid valve 224 disposed in the pipe 222 leading to the weft inserting nozzle 17, and the solenoid valve 230 disposed upstream of the tank 231 connected to the auxiliary nozzles 189 are opened.

Subsequently, the loom operating switch 311 is closed. Then, the electromagnetic brake 255 is switched off, and the main motor 250 is driven. Accordingly, the loom main shaft 252 is rotated through the pulley 251, the belt 254, and the pulley 253.

During operation of the loom, the drive shaft 84 is driven to rotate by the main shaft 252 through the gears 258 and 259. The rotation of drive shaft 84 causes the shaft 86 to rotate through the toothed pulley 85, the cogged belt 89, and the toothed pulley 88, and further causes the change-over member 100 to rotate through the coupling 90 and the shaft 92. The change-over member 100 drives the connector 96 to rotate through the engaging clutch 94, and further the shaft 77 to rotate through the bolt 98, the ring 82, the bolt 83, and the hollow shaft 80. The shaft 71 is rotated by the shaft 77 through the gears 79 and 74. Then, the shaft 71 rotates once per each rotation of the main shaft 252.

Upon rotation of the gear 74 fixedly mounted on the shaft 71, the shaft 135 is rotated through the gear 136 which is in engagement with the gear 74. Then, the shaft 135 also rotates once per each rotation of the main shaft 252. The rotated shaft 135 causes the cams 137, 138 fixedly mounted thereon, to rotate so that the sliding rods 149, 150 make their reciprocating movement at predetermined timings under the force transmission through the cam rollers 143, 144, the levers 141, 142, the rollers 153, 154, and the drive frames 151, 152. This causes the engaging pins 155, 156 to be inserted into or withdrawn from the holes 159, 161, respectively, at predetermined times. The rotation of the shaft 71 causes the gear 73 fixedly mounted on the shaft 71 to rotate, and accordingly the shaft 66 is rotated through the gear 69. The rotation of the shaft 66 causes the rotatable shaft 44 to rotate under the force transmission through the gears 68, 64. Then, the rotatable shaft 44 rotates four times per one rotation of the main shaft 252, so that the weft guide pipe 53 rotates around the drum 48 thereby to wind up the weft yarn 10 on the drum 48.

Thus, under rotation of the weft guide pipe 53, the weft yarn 10 of a predetermined length required for one weft picking is wound on the drum straight section **48*b* between the engaging pins 155 and 156 by a time point immediately before the weft picking. When the weft picking step has come, the mechanical valve 225 is first opened to eject pressurized air from the weft inserting nozzle 17. Immediately after this, the engaging pin 156 is withdrawn from the hole 161 to release the weft yarn 10, so that the weft yarn 10 is drawn or pulled by the air ejection from the weft inserting nozzle 17 and inserted through the guide opening 197 of the picked weft yarn removing pipe 196 into the weft guide groove 187. In timed relation to this, the mechanical valve 233 for the auxiliary nozzle 189 is opened slightly before the tip end section of the weft yarn 10 passes by the auxiliary nozzle 189, thereby ejecting pressurized air from the auxiliary nozzle 189. Thus, the tip end of the weft yarn 10 is successively blown away along the weft guide groove 187 under the influence of air jets which are successively ejected from the auxiliary nozzles 189 disposed along the weft guide groove 187. The mechanical valve 233 for the auxiliary nozzle 189, by which the tip end section of the weft yarn 10 has passed, is closed to stop air ejection from the auxiliary nozzle 189. The weft picking of the weft yarn 10 is completed when the weft yarn 10 is engaged with the engaging pin 156; immediately before this the mechanical valve 225 is closed to stop the air ejection from the weft inserting nozzle 17**.

At the step of beating-up, after the engaging pin 156 is inserted into the hole 160, the engaging pin 155 is withdrawn from the hole 159, so that the weft yarn 10 (of the length required for one weft picking) wound on the drum tapered section **48*a* removes to the drum straight section 48*b*. Thereafter, the engaging pin 155 is again inserted into the hole 159 to engage with the continuously wound weft yarn 10. In this state, the weft reservoir 15 stands ready for the next weft picking. It is to be noted that the solenoid valve 215 is opened simultaneously with a main electric source being switched on, in which a weak air stream is always ejected from the nozzle opening 34 of the nozzle 27 to draw the weft yarn 10 in the direction opposite to the advancing direction of the weft yarn 10, i.e., in the direction from the side of the drum 48 to the side of the yarn supplier 9A, thereby providing tension to the weft yarn 10**.

During loom operation, the controller watches for signals from the weft feeler 320, the warp feeler 321, and the loom stopping switch 312. For example, in case a mispick arises so that the weft feeler generates a stopping signal, a loom stopping angle is set at 180 degrees in an open shed state, and thereafter the solenoid valves 224, 230 are closed to prevent excessive air ejection while main motor 250 is switched off and the electromagnetic brake 255 is switched on. It is to be noted that in case a warp cutting arises so that a loom stopping signal is generated from the warp feeler 321 or in case the loom stopping switch 312 is closed, the loom is stopped in that the electromagnetic brake 255 is applied when the loom stopping angle is set at 300 degrees in a closed shed state which is suitable for restoring the warp yarn 2.

At this loom stopping step, the mispicked weft yarn 10 is cut by the cutter 21 upon being beaten-up by the reed 5, and then the next weft picking is made under the influence of the remaining air in the pipes downstream of the solenoid valves 224, 230. The loom stopping is made at approximately 200–300 degrees at the beating-up step, in which the last picked weft yarn 10 is being connected to the weft inserting nozzle 17, without being cut.

Next, discrimination is made by CPU 301 as to whether a pulse signal is input from the angle sensor 309 within a predetermined time period or not. A decision of loom stopping is made when there has been no input of the pulse signal. After making the decision of loom stopping, an actual or present rotational angle (loom stopping angle) read from the pulse signal of the angle sensor 309 is compared with a preset loom stopping angle. When the present loom stopping angle exceeds the preset loom stopping angle (this condition being nearly reached in case of loom stopping due to mispick or failed weft picking), the electromagnetic clutch 257 is switched on (engaged) to make connection of the inching motor 257 while the loom operation indicating lamp 346 is lighted, thereafter a clutch disengaging signal is generated to disengage the clutch 94.

Figure 17A:
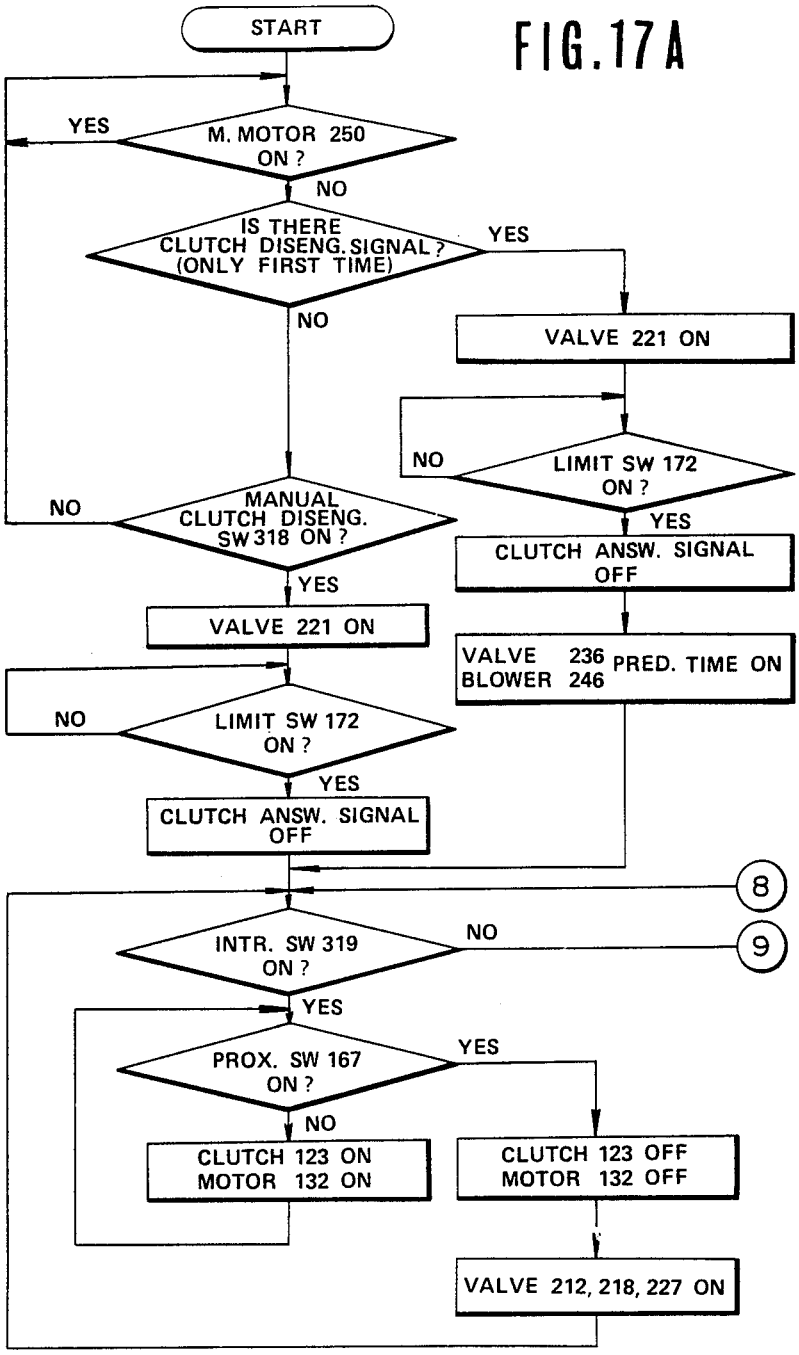
Figure 17B:
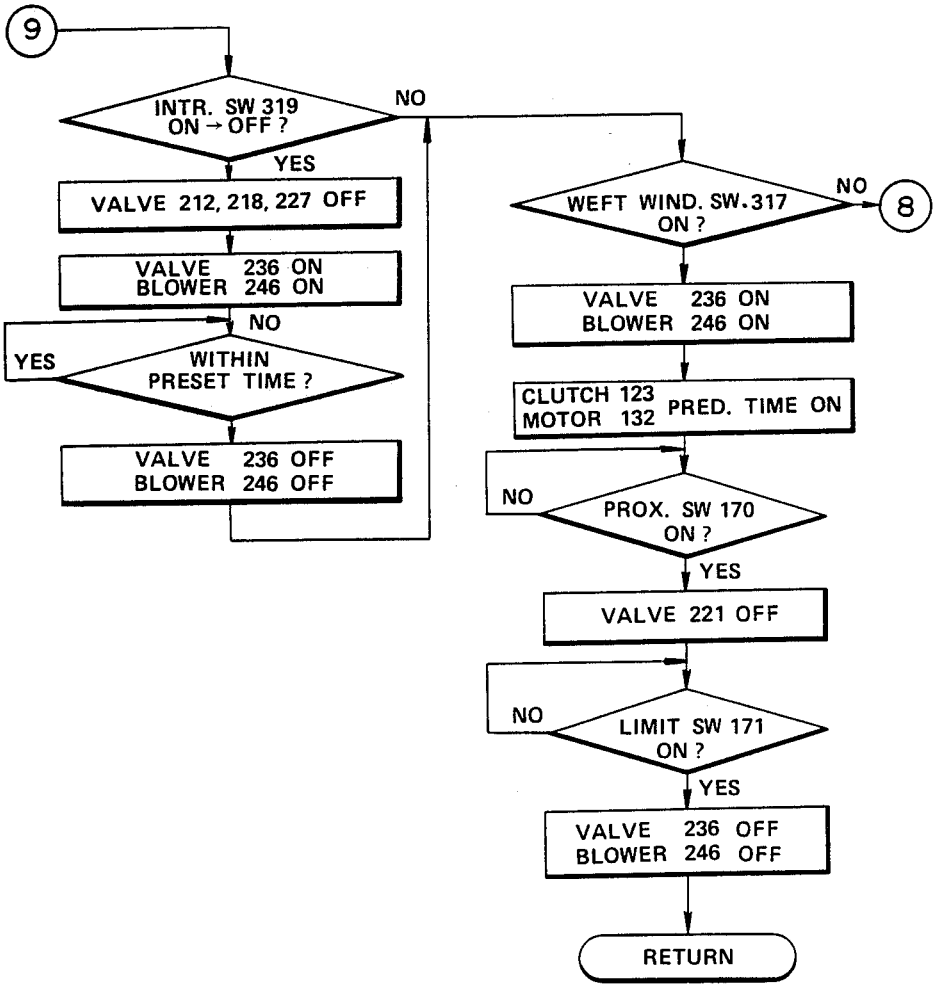

Meanwhile, another or separate CPU 301' is operating in accordance with a flow chart as shown in FIG. 17. That is, as an interlock, a discrimination by CPU 301' is first made as to whether the main motor 250 is switched on or off. If switched off, i.e., in case of other than normal loom operation, watching is made as to whether a clutch disengaging signal (only a first time) is generated or not, and as to whether the manual clutch disengaging switch 318 is closed or not. When the first time clutch disengaging signal is generated, the solenoid valve 221 is opened to blow pressurized air into the actuator 114. Accordingly, the piston rod 115 is extended to allow the changeover lever 103 to rotate clockwise in FIG. 11 through the receiver 110 and the pin 111, thereby moving the change-over member 100 rightward through the rollers 104, 105 to put the engaging clutch 94 into a disengaged state. Then, if the limit switch 172 is recognized to be switched on, a clutch answer signal is changed to OFF and output, and the solenoid valve 236 and the blower 246 are switched on for a predetermined time period.

In the flow chart in FIG. 17, when the manual clutch disengaging switch 318 is closed, the valve 221 is opened to disengage the engaging clutch 94 while the clutch answer signal is changed to OFF and output after the limit switch 172 is confirmed to be switched on. After the above-mentioned operation takes place upon generation of the clutch disengaging signal or closure of the manual clutch disengaging switch 318, the controller checks whether the weft introduction switch 319 is closed or not or whether the weft winding switch 317 is closed or not.

Figure 16A:
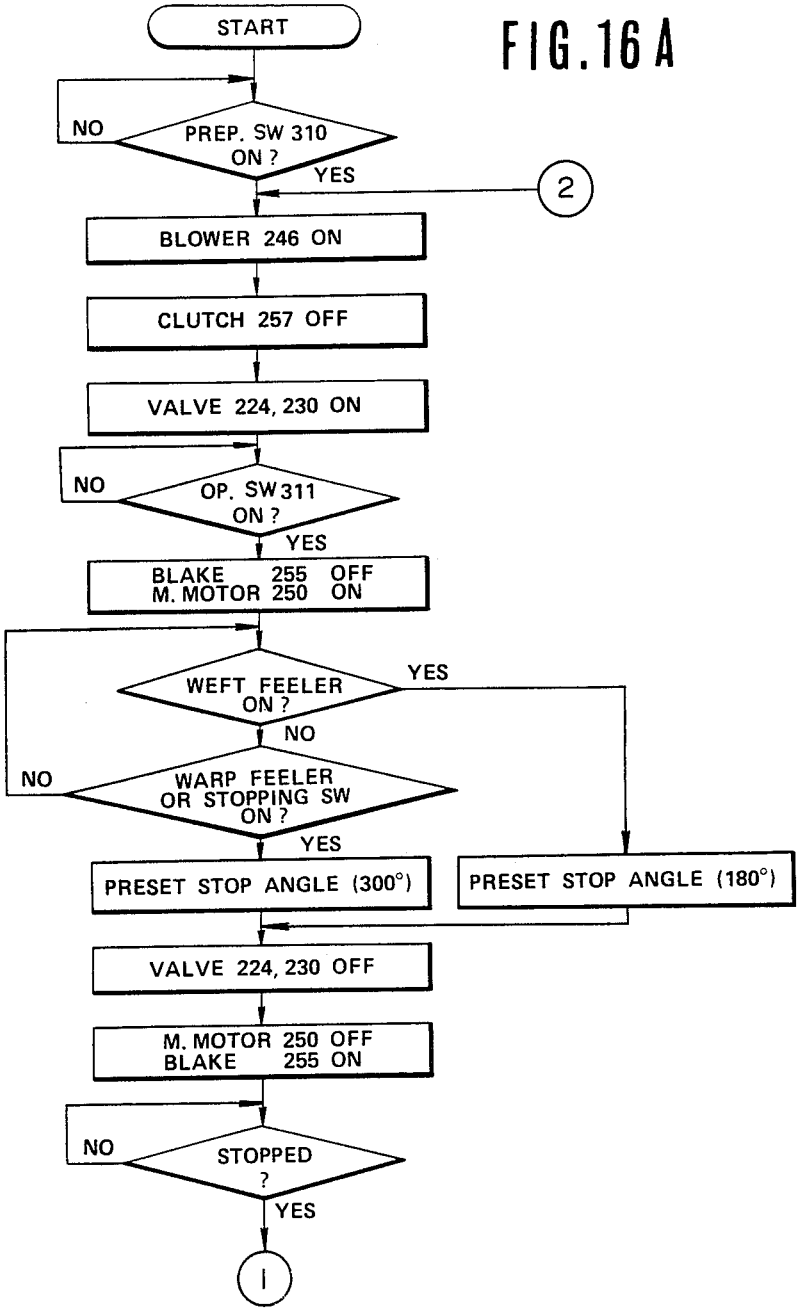
FIGS. 16A, 16B and 17 are flow charts showing a software arrangement of the control system of FIG. 14.
Figure 16B:
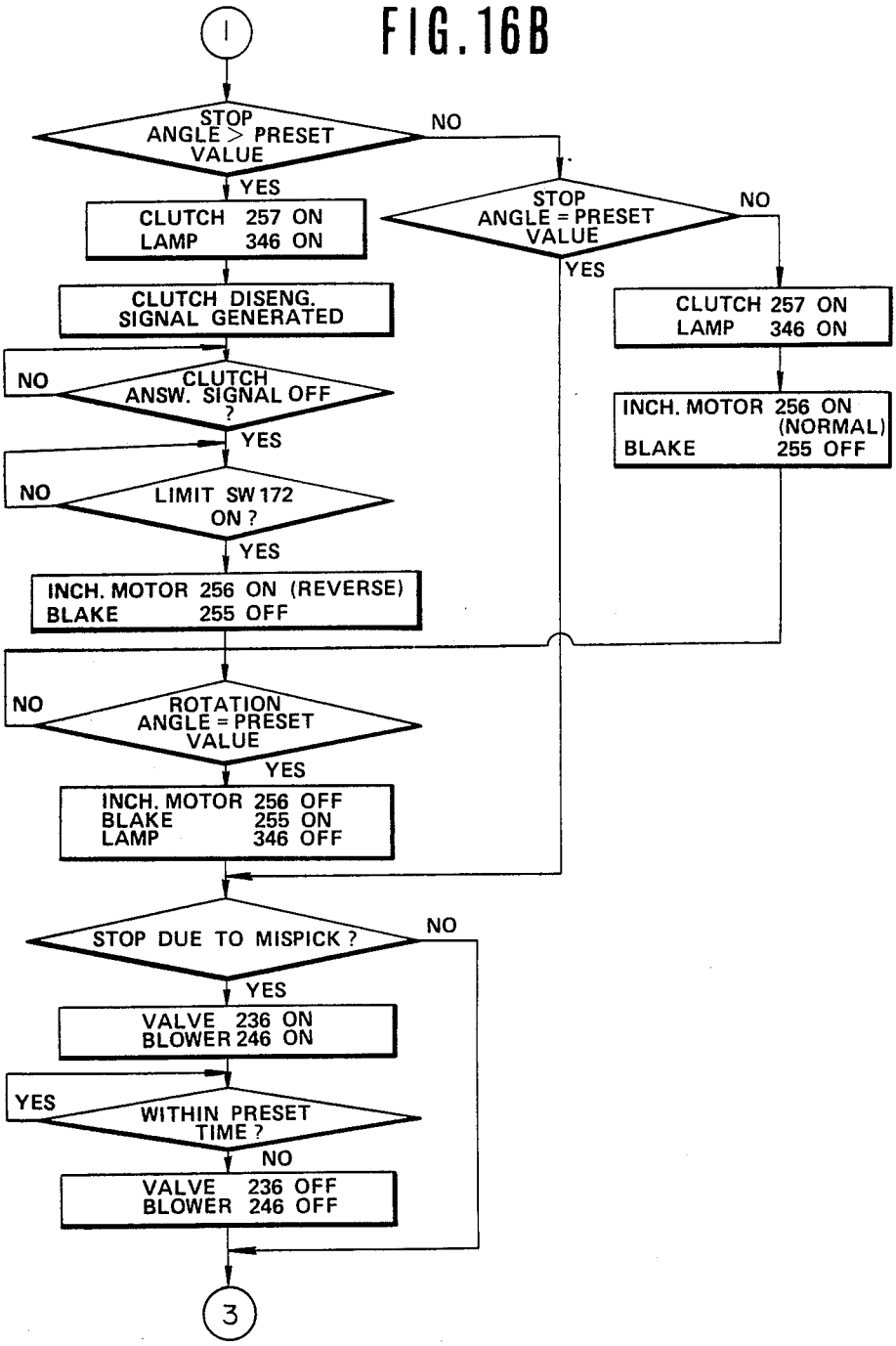
Figure 16C:
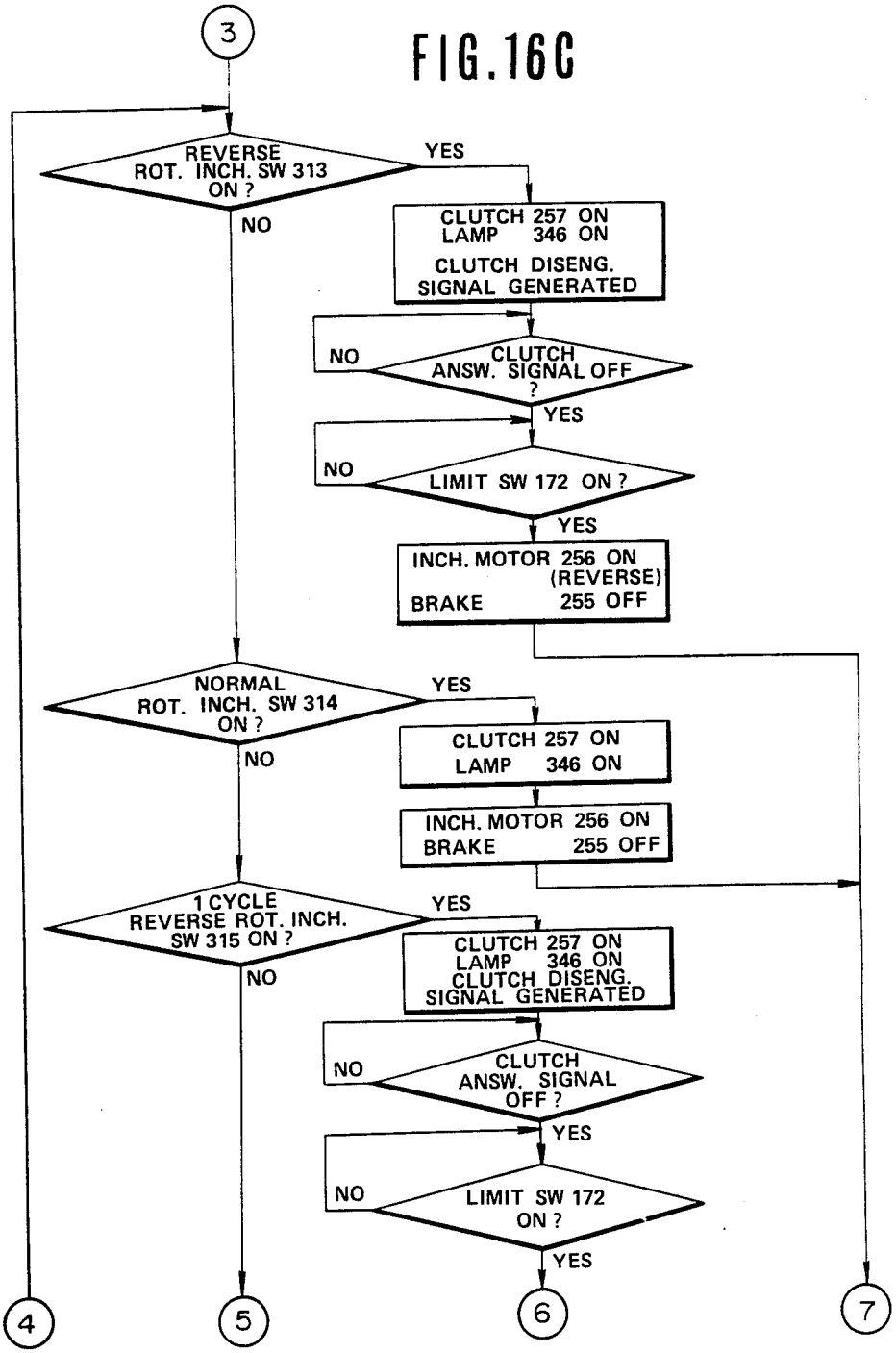
Figure 16D:
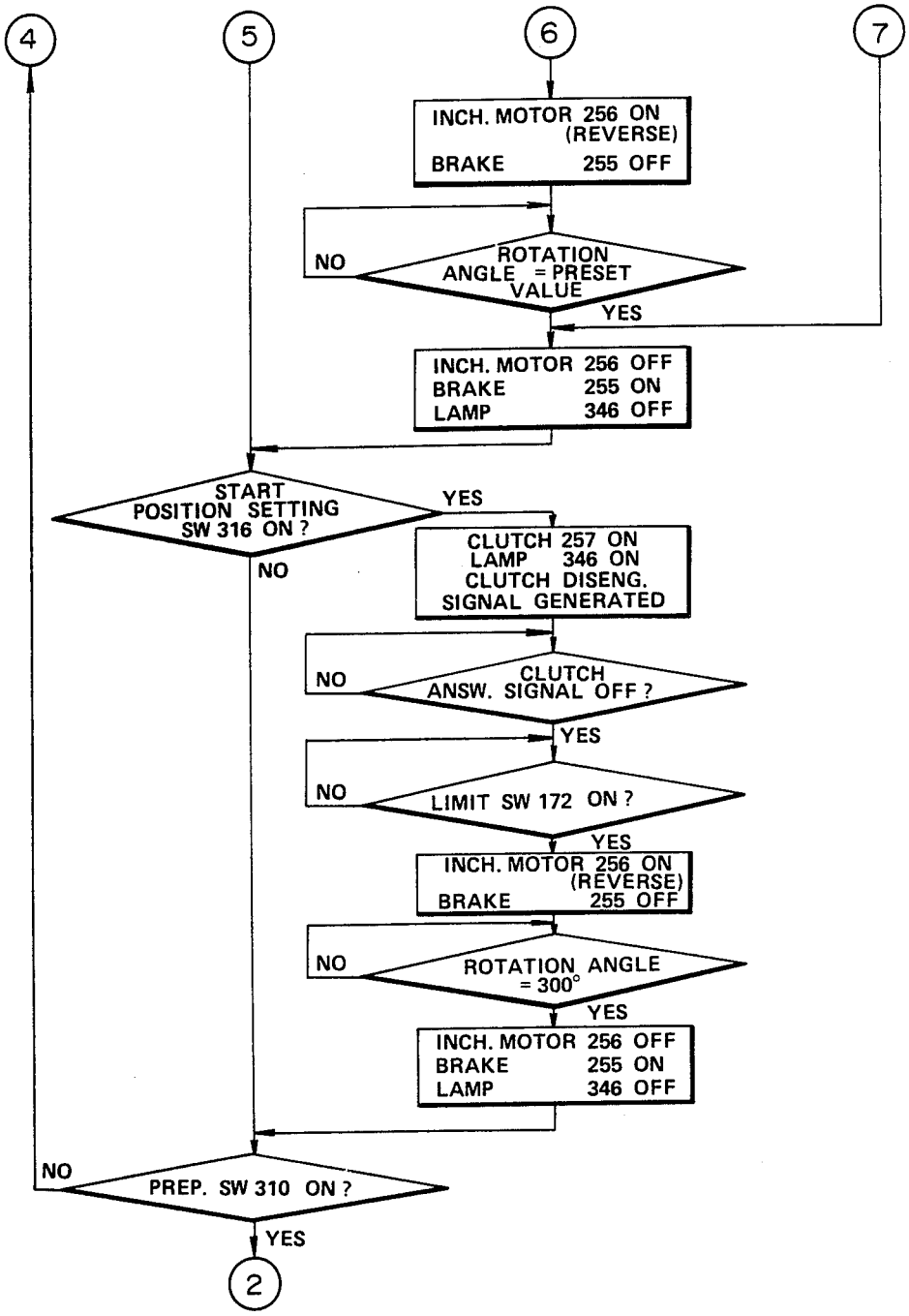

Turning to the flow charts in FIGS. 16A and 16B, whei it is confirmed that the clutch answer signal from the other CPU 301' is OFF and the limit switch 172 is switched on, the inching motor 256 is switched on to make its reverse rotation, and the electromagnetic switch 255 is switched off, so that the main shaft 252 is reversely rotated through the electromagnetic clutch 257 by the inching motor 256. At this time, since the clutch 94 is in the disengaged state, the weft reservoir 15 is not operated while operating the side of a weaving section of the loom. When the angle signal from the angle sensor 309 reaches a valve of the preset loom stopping angle in the process of detecting the angle signals, the inching motor 256 is switched off, the electromagnetic brake 255 is switched on to effect a braking action, and the lamp 346 is put out. When the actual loom stopping angle does not exceed the preset loom stopping angle, discrimination is made by CPU 301' as to whether the actual loom stopping angle agrees with the preset loom stopping angle. If agreement is found, loom stopping is maintained as it is. If the agreement is not found, i.e., the actual loom stopping angle has not reached the preset loom stopping angle (this condition is reached in case of loom stopping due to warp yarn cutting), the electromagnetic clutch 257 is switched on (or engaged), and after the lamp 346 is lighted the inching motor 256 is switched on to normally rotate while the electromagnetic brake 255 is switched off thereby to drive the weaving section of the loom and weft reservoir 15 to normally revolve at a low speed. When the actual loom stopping angle has reached the preset loom stopping angle, the inching motor 256 is switched off, the electromagnetic brake is switched on to effect a braking action, and the lamp 346 is put out.

After the loom has been stopped at the preset loom stopping angle, in case of loom stopping due to mispick or failed weft picking, the blower 246 is operated simultaneously with the opening of solenoid valve 236. Upon opening of the solenoid valve 236, pressurized air is supplied through the pipe 210 and the connector 199 into the removing pipe 196, thereby generating a high speed air stream flowing from the upstream pipe section **196*b* to the downstream pipe section 196*a* traversing a guide space between the guide openings 197. Additionally, an air stream for sucking is generated within the downstream pipe section 196*a* upon operation of the blower 246. Thus, the weft yarn 10 inserted through the guide openings 197 is blown downward under the influence of the air stream directed downward traversing the guide space between the guide openings 197, and the thus blown weft yarn 10 is effectively sucked into the downstream pipe section 196*a* under the influence of the sucking air stream by the blower 246, thereby pulling out the lastly picked weft yarn 10. Such an operation is carried out for a time period preset in the presetter, and accordingly when a time lapse has occurred for the preset time period, the solenoid valve 236 is closed and the blower is switched off. While the air stream for removing the lastly picked weft yarn has been described as being generated after stopping loom operation in this instance, it will be understood that the air stream may be generated simultaneously with the operation of the electromagnetic brake 255** to also accomplish the weft yarn removing action in the loom stopping process.

After the lastly picked weft yarn is automatically removed upon loom stopping due to mispick, the one cycle reverse rotation inching switch 315 is closed by an operator. When the one cycle reverse rotation inching switch 315 is closed upon being pushed for a moment, the electromagnetic clutch 257 is switched on, the lamp 346 is switched on, and the clutch disengaging is generated. In case the clutch 94 has already been disengaged while the clutch answer signal has become OFF, the inching switch motor 256 is switched on and the electromagnetic brake is switched off after the limit switch 172 is confirmed to be switched on, thereby reversely rotating the main shaft 252 of the loom at a low speed. At this time, since the clutch 94 is in the disengaged state, measurement and detaining operation of the weft yarn cannot take place, thereby preventing the weft yarn 10 from wasting. Thereafter, when the reverse rotation of the loom has made one cycle in order to reach the preset loom stopping angle (180 degrees), the inching motor 256 is switched off, the electromagnetic brake 255 is switched on, and the lamp 346 is switched off, thereby stopping the loom. In this state, the mispicked weft yarn 10 is pulled out. During this loom stopping, if the reverse rotation inching switch 313 is closed, only the loom main shaft 252 can be intermittently reversely rotated at a low speed while the switch is pushed. If the normal rotation inching switch 314 is closed, the loom main shaft 252 (the main shaft 252 and the weft reservoir 15 in case the clutch 94 is engaged) can be intermittently normally rotated at a low speed while the switch is pushed.

In order to put the loom in starting condition for re-starting after pulling out the mispicked weft yarn, it is necessary to put the main shaft 252 and the weft reservoir 15 into a condition suitable for closed shed starting. For this purpose, the starting position setting switch 316 and the weft winding switch 317 are usually closed by the operator in the mentioned order.

When the starting position setting switch 316 is first closed, the electromagnetic clutch 257 is switched on and the lamp 346 is switched on while generating the clutch disengaging signal. If the clutch 94 is disengaged and the clutch answer signal becomes OFF, the inching motor 256 is switched on and electromagnetic brake 255 is switched off after the limit switch 172 is confirmed to be switched on, thereby reversely rotating the loom main shaft 252 at a low speed. When the loom reverse revolution has reached 300 degrees in closed shed starting, the inching motor 256 is switched off, the electromagnetic brake 255 is switched on, and the lamp 346 is switched off, thereby stopping the loom. Thus, the position setting for the main shaft 252 is completed.

Subsequently, when the weft winding switch 317 is closed, the solenoid valve 236 is opened and the blower 246 is operated as shown in the flow chart in FIG. 17, thus generating the ejection air stream in the removing pipe 196 upstream of the guide opening 197 and the suction air stream in the pipe 196 downstream of the guide opening 197. Immediately after generation of such air streams, the electromagnetic clutch 123 and the weft winding motor 132 are switched on for a predetermined time period. Due to this, the electromagnetic 129 of the electromagnetic clutch 123 attracts the attraction plate 124 to be pressed on the friction plate 126, while the rotation of the weft winding motor 132 causes the shaft 71 to rotate at a low speed through the gear 134, the gear 122, the pin 125, the attraction plate 124, the friction plate 126, and the key 127. Upon rotation of the shaft 71, the shaft 135 is rotated through the gears 74, 136, so that the cams 137, 138 are driven to allow the engaging pins 155, 156 to be inserted into or withdrawn from the holes 159, 160, respectively. In timed relation to the movement of the engagement pins 155, 156, the rotatable shaft 44 is rotated by the gears 73, 69, the shaft 66 and the gears 68, 64 due to the rotation of the shaft 71 in order to accomplish winding of the weft yarn 10 on the drum 48.

When the phase of the weft reservoir 15 becomes 300 degrees in angle, the iron piece 169 faces the proximity switch 170 to allow the switch 170 to be switched on, thereby closing the solenoid valve 221. Accordingly, the piston rod 15 is withdrawn under the action of a spring (not shown) disposed within the air actuator 114, and the change-over member 100 is moved leftward in FIG. 11, i.e., toward the side of the connector 96 under the biasing force of the spring 102, thereby allowing the tooth (projection) 95 at the end face of the change-over member 100 to contact the end face of the connector 96. It is to be noted that the clutch 94 is adapted to engage only at a certain phase (300 degrees). When, the phase of the weft reservoir 15 has already exceeds 300 degrees in angle, the limit switch 171 is still switched off while the limit switch 172 is still switched on. Thus, upon further rotation of the weft winding motor 132 with the teeth 95, 99 of the clutch 94 in condition to contact each other, the teeth 95, 99 are at last brought into mesh with each other when the weft reservoir phase next reaches 300 degrees. In this state, even if the weft winding motor 132 has been switched on, the weft winding motor 132 does not rotate under the action of load caused by the meshing of the teeth 95, 99 on the side of the main shaft 252, so that the weft reservoir 15 does not operate. Thereafter, upon lapse of a time, the electromagnetic clutch 123 is switched off and the weft winding motor 132 is switched off. At this stage, the change-over member 100 is fully moved leftward under the bias of the spring 102 upon disappearance of rotational torque, so that the teeth 95, 99 are fully brought into mesh with each other while the limit switch 171 is switched on and the limit switch 172 is switched off. At angular phases other than 300 degrees, the teeth 95, 99 of the clutch are not brought into complete mesh with each other, so that the change-over member 100 does not move as far leftwardly as is possible.

During this, discrimination is made by CPU 301 as to whether the limit switch 171 is switched on or not. If it is switched on, the solenoid valve 236 is closed while the blower 246 is switched off. This causes the weft guide pipe 53 to rotate four times from 300 degrees, which corresponds to one cycle in phase of the loom. During this time period, the weft yarn 10 is wound on the drum 48 by the weft guide pipe 53 while the engaging pins 155, 156 are inserted into or withdrawn from the holes 159, 161, respectively. Accordingly, when the engaging pin 156 is withdrawn from the hole 161, the weft yarn 10 is drawn out under the influence of suction air stream within the removing pipe 196, so that the weft yarn 10 between the drum 48 and the removing pipe 196 stands ready in a state of tension.

In the state where the clutch 94 has been automatically disengaged, the clutch 94 is again engaged so that it is preset in the state where the loom has been stopped because driving is stopped. When the abovementioned starting operation (without weft picking) is made in this state, the loom operation again starts. That is, upon closure of the starting preparation switch 310, the operation returns an earlier position in the flow chart in FIGS. 16A and 16B, so that the operation is again initiated upon closure of the loom operation switch 311.

In order to introduce the weft yarn 10 to pass through the air tensor 12, the rotatable shaft 44, the weft guide pipe 53 and the weft inserting nozzle, the weft introduction switch (foot switch) 319 is closed prior to closure of the weft winding switch 317. Then, discrimination is made by CPU 301 as to whether the proximity switch 167 is switched on or not, i.e., whether the weft guide member 53 is brought into an upper position (or a position for facilitating the operation) or not. If the weft guide member 53 is not brought into the upper position, the electromagnetic clutch 123 is switched on, and the weft winding motor 132 is driven.

Consequently, the shaft 71 is rotated at a low speed via the output shaft 133, the gear 134, the gear 122, the pin 125, the attraction plate 124, the friction plate 126, and the key 127. The rotation of the shaft 71 causes the shaft 135 to rotate through gears 74, 136, so that the cams 137, 138 are driven thereby to allow the engaging pins 155, 156 to be projected or withdrawn. In timed relation to this, i.e., upon rotation of the shaft 71, the rotatable shaft 44 is rotated through the gears 73, 69, the shaft 66, and the gears 68, 64, so that the weft yarn 10 is wound on the drum 48 by the weft winding pipe 53. When the weft guide pipe 53 faces the proximity switch 167, the electromagnetic clutch 123 and the weft winding motor 132 are switched off. This is made to locate the weft guide pipe 53 on the upper side in order to facilitate the operation.

Then, the solenoid valves 212, 218, 227 are opened, so that pressurized air is ejected from the weft introduction air nozzle opening 56 in the rotatable shaft 44 and from the weft inserting nozzle 17. Upon air ejection from the weft introduction nozzle 26, air fed into the pipe 25 under pressure is ejected through the weft introduction opening 31 of the nozzle 27 since the nozzle 26 is adapted to be larger in air flow amount than the nozzle 26 for tension providing purpose. Accordingly, when the weft yarn 10 is brought to the inlet section of the weft introduction opening 31 of the nozzle 26, the weft yarn 10 is drawn into the pipe 25 under the sucking action of the air stream generated there, and subsequently discharged from the weft introduction opening 31 of the nozzle 27. Thereafter, the tip end section of the weft yarn 10 is brought into the inlet section of the weft introduction opening 54 of the weft introduction pipe 55 of the rotatable shaft 44, and sucked into the weft introduction opening 54 under the influence of an air stream flowing from the nozzle opening 56 through the weft introduction hole 52 and discharged out of the tip end section of the weft guide pipe 53. Thus, the weft yarn 10 is discharged from the tip end section of the weft guide pipe 53 into between the ballooning cover 60 and the drum 48. Therefore, when the tip end section of the weft yarn 10 is brought to the inlet section of the weft inserting nozzle 17 upon passing through the guide 18, it is suched into the weft inserting nozzle 17 and discharged from its outlet section to be inserted into the guide opening 197 of the picked weft yarn removing pipe 196. Thus, the introduction operation of the weft yarn 10 into the various devices can be easily accomplished.

When the weft introduction operation has been completed, the weft introduction switch (foot operated switch) is released to be switched off. Accordingly, upon discrimination by CPU 301 of the weft introduction switch 319 being changed from the ON position to the OFF position, the solenoid valves 212, 218, 227 are closed to stop ejection of air for weft introduction. Then, the solenoid valve 236 is opened, for example for 5 seconds which is set by the presetter in order to generate a descending air stream in the picked weft yarn removing pipe 196, while the blower 202 is switched on for the same time period thereby to positively suck the descending air stream into the removing pipe 196 through the filter 244 and the pipe 202. Consequently the tip end section of the weft yarn 10 passing through the guide opening 197 of the removing pipe 196 is sucked into the removing pipe 196. Thereafter, the weft winding switch 317 is closed.

Figure 18:
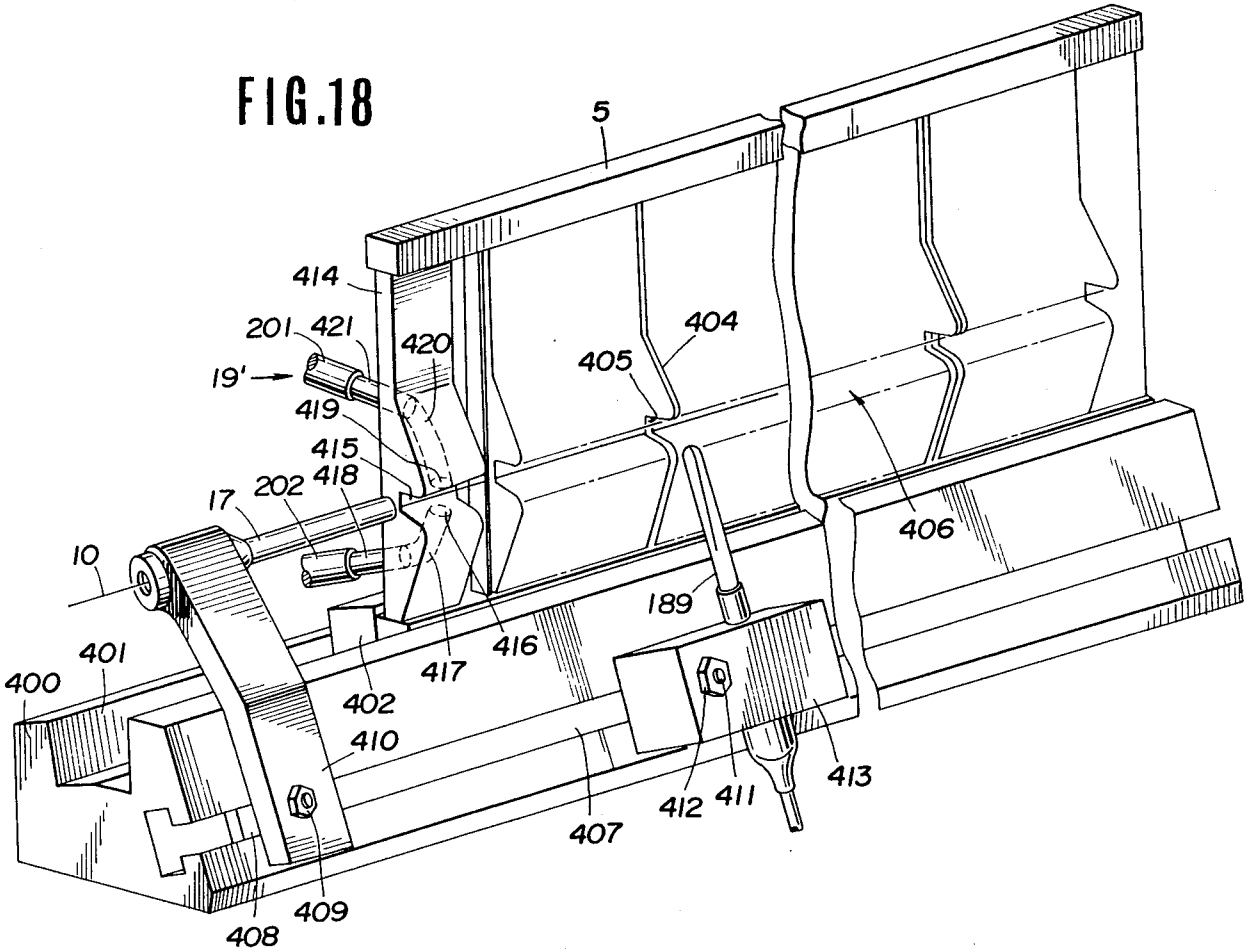
FIG. 18 is a fragmentary perspective view of another example of the picked weft yarn removing device.
Figure 19:
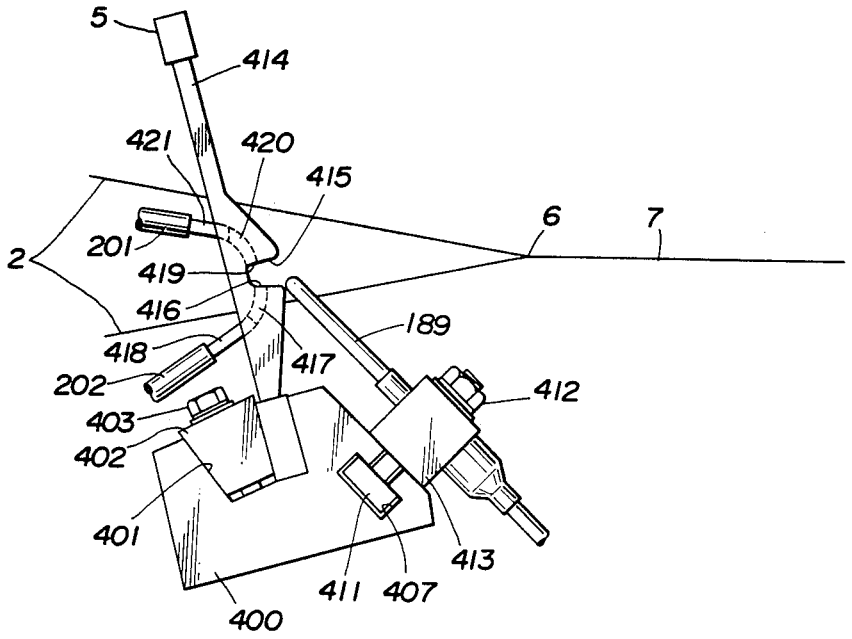
FIG. 19 is a side elevation of the picked weft yarn removing device of FIG. 18.

FIGS. 18 and 19 illustrate another example of the picked weft yarn removing device 19' which is similar in principle to the above-discussed corresponding device 19. As shown, the reed 5 is fixed in position in such a manner that its lower frame is inserted together with a wedge member 402 in a laterally extending groove 401 of a reed holder 400 which is swingingly movable forward and backward under the action of the sley sword 180 (shown in FIG. 2), the wedge member 402 being forced in by screwing in bolts 403. A plurality of reed blades 404 of the reed 5 are formed respectively with grooves 405 which are located on the side of the cloth fell. The aligned grooves 405 constitute a weft guide groove or channel 406. The weft inserting nozzle 17 is fixedly supported by a holder 410 which is fixed in position by a headed bolt 408 fitted in a laterally extending groove 407 and a nut 409. The groove 407 has a T-shaped cross-section and opens to the front side surface. The weft inserting nozzle 17 faces and is aligned with the weft guide groove 406. A plurality of auxiliary nozzles 189 are aligned along the weft guide groove 406 at predetermined intervals. Each auxiliary nozzle 189 is supported by a holder 413 which is fixed in position by a headed bolt 411 fitted in the groove 407 and a nut 412.

A parent reed blade or guide member 414 located on the weft picking side forms part of the picked weft yarn removing device 19'. The parent reed blade 414 is aligned with the reed blades 404 and fixedly disposed between the upper and lower frames of the reed 5, and is located on the side of the weft inserting nozzle 17 relative to the rows of the warp yarns 2. The parent reed blade 414 has the same cross-sectional shape as the reed blades 404 and therefore is formed with a groove 415 (or the guide space) whose cross-section is the same as that of the reed blades 404, so that the parent reed blade groove 415 is aligned with the reed blade groove 405.

Figure 20:
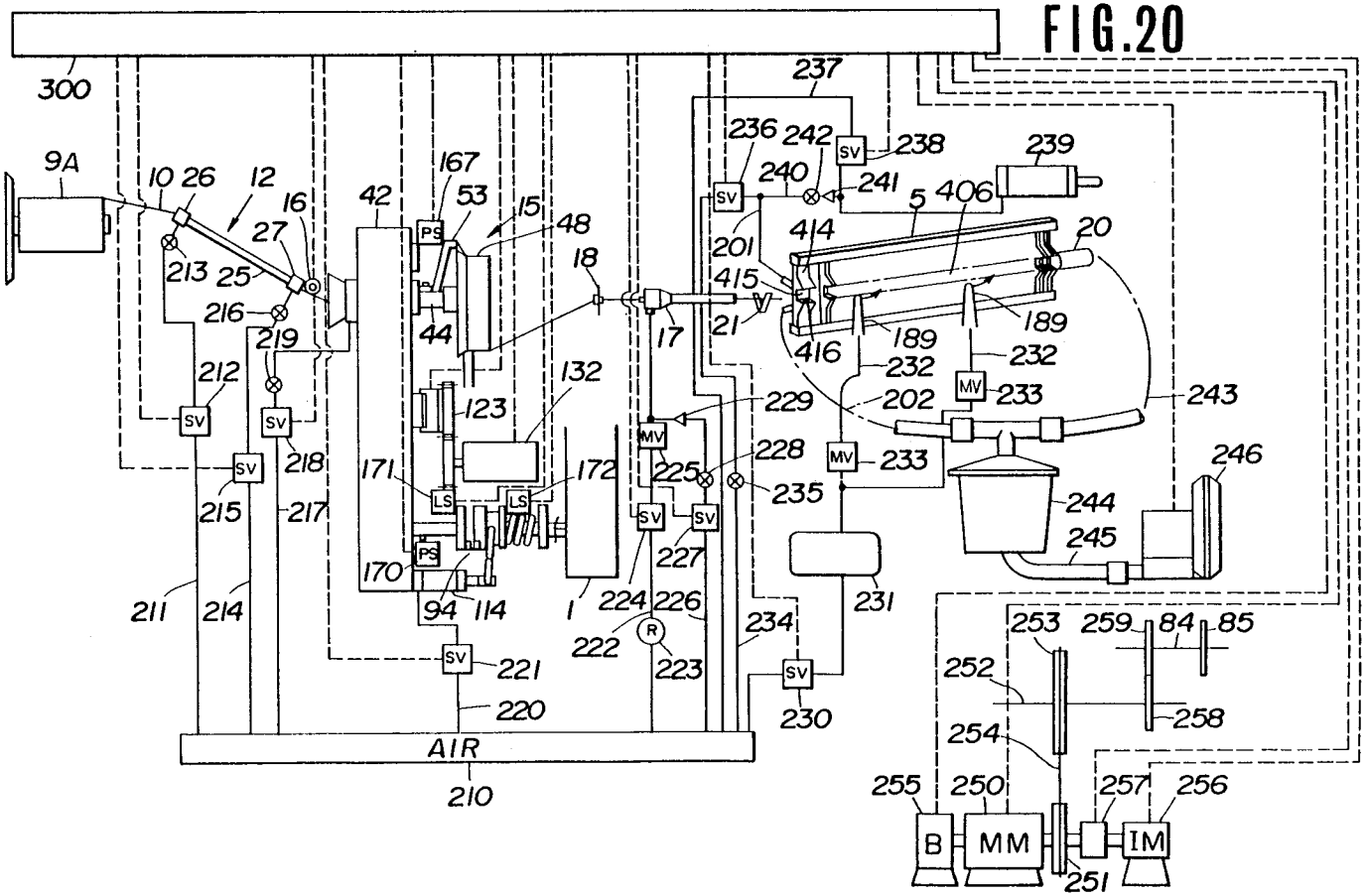
FIG. 20 is a circuit diagram similar to FIG. 14, but showing a control system of the loom using the picked weft yarn removing device of FIG. 18.

As shown, the parent reed blade 414 is considerably wider than the reed blade 404, and therefore its groove 415 is wider than that of the reed blade 404. The groove 415 of the parent reed blade 414 is defined by upper and lower wall faces which are opposite each other, and a side wall face located generally perpendicular to the upper and lower wall faces, so that the groove 415 opens to the side of the cloth fell. The parent reed blade 414 is formed at the lower wall face with a suction opening 416 which opens to the groove 415. Additionally, an induction passage 417 (or air flow passage) in communication with the suction opening 416 is formed in the body of the parent reed blade 414. A connector pipe 418 is connected to the induction passage 417. The flexible pipe 202 is connected to the connector pipe 418 and leads to the suction port of the blower 246 via the filter 244 and the pipe 245 as shown in FIG. 20. Furthermore, the parent reed blade 414 is formed at the upper wall face with an ejection opening 419 which is in communication with an induction passage 420 formed in the body of the parent reed blade 414. A connector pipe 421 is connected to the induction passage 420. The flexible pipe 201 is connected to the connector pipe 421. This pipe 201 leads to the pipe 234 from the pressurized air supply source 210 via the flow amount regulating valve 235 and the solenoid valve 236. It will be understood that, in this instance, the parent reed blade 414 serves as a weft yarn restraining member for restraining the picked weft yarn 10 until beating-up by the reed 5.

With this configuration, during normal loom operation, the weft yarn 10 is picked through the parent reed blade groove 415 into the weft guide groove 406 constituted by the row of the aligned reed blade grooves 405 under the influence of an air jet ejected from the weft inserting nozzle 17, in which auxiliary air jet ejection is made from the respective auxiliary nozzles 189 with advance of the tip end section of the weft yarn 10 to successively blow away the weft yarn 10 along the weft guide groove 406, thus achieving a weft picking.

Now, if mispicking or failed weft picking arises during such a weft picking process, the loom is stopped at the next beating-up step in which the weft yarn 10 is being pushed deeply in the groove 415 of the parent reed blade 414 so that the weft yarn 10 certainly exists in the groove 415. Accordingly, when the solenoid valve 236 in FIG. 20 is opened and the blower 246 is operated, air is ejected from the ejection opening 419 to force the weft yarn 10 into the suction opening 416, and the weft yarn 10 is simultaneously sucked into the suction opening 416. The weft yarn 10 is then sucked into the pipe 202 through the induction passage 417 and the connector pipe 418, thus pulling out the last picked weft yarn 10 from the shed of the warp yarns 2. The weft yarn 10 is cut by the cutter 21 in the position between the weft inserting nozzle 17 and the parent reed blade 414 at re-starting of the loom.

Figure 21:
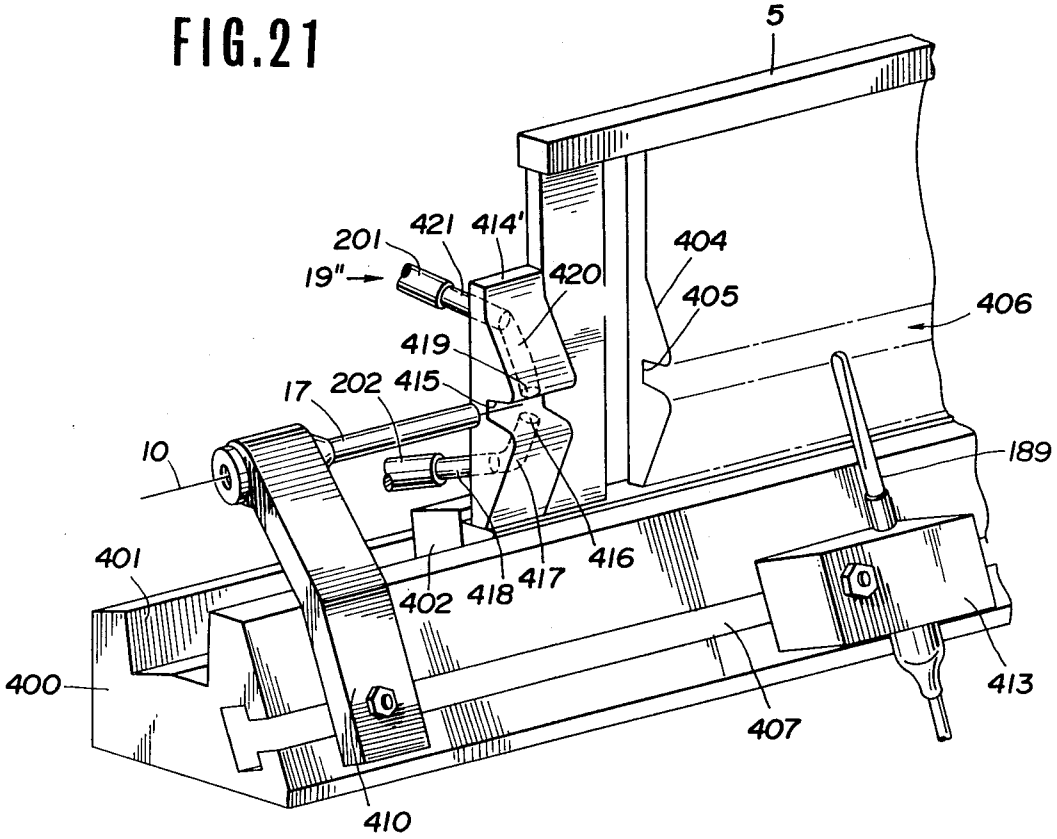
FIG. 21 is a fragmentary perspective view similar to FIG. 18, but showing a further example of the picked weft yarn removing device.

FIG. 21 illustrates a further example of the picked weft yarn removing device 19" which is similar to the device 19' of FIGS. 18 and 19 with the exception that the weft yarn restraining member or guide member 414' is not formed integral with the reed 5 so that the parent reed blade does not serve as the weft yarn restraining member. In this example, the weft yarn restraining member 414' is shaped similar to the parent reed blade 414 of FIG. 18 and has a similar configuration, but is disposed separately and independently from the reed 5.

As will be appreciated from the above, the above-discussed loom is equipped with the picked weft yarn removing device which is arranged such that the weft yarn projected from the weft inserting nozzle and lying in a guide space can be forced into an air flow passage under the influence of an air stream developed through the guide space. Accordingly, the weft yarn to be removed certainly lies restrained in the guide space in the state to be passed therethrough at any time and therefore forcing the weft yarn into the air flow passage can be surely effected, thereby facilitating re-starting the loom.

Additionally, the above-discussed loom is equipped with a loom starting device by which preparation of starting the weft reservoir can be made only upon operating the manual switch for weft winding after the phase of the loom main shaft is set for starting, thereby greatly facilitating preparation of the loom for starting. Particularly, the starting phase of the main shaft is obtained after at least one weft yarn winding is made on the drum of the weft reservoir, regardless of weft reservoir condition as to whether no weft yarn or some weft yarn has been wound on the drum of the weft reservoir, thereby making the loom very practical.

What is claimed is:

1. A loom comprising:

a drum type weft reservoir having a drum on which a weft yarn is wound to be measured and reserved prior to weft picking, upon said reservoir being driven;

a clutch through which said weft reservoir is drivably connected with a main shaft of the loom upon being engaged, said clutch being engageable at a predetermined operational phase of the loom;

first means for detecting the state of said clutch to produce a signal representative of a disengaged state of said clutch;

second means for detecting the operational phase of said weft reservoir to produce a signal;

third means for driving said weft reservoir, upon being operated;

a manually operated switch for producing a signal commanding weft yarn winding on said weft reservoir drum, upon being operated;

fourth means for operating said third means for a predetermined time upon receiving the signal from said manually operated switch and the signal from said first means, upon being operated; and fifth means responsive to the signal from said second means to change over said clutch into its engageable state at a second timing substantially later than a first timing at which said predetermined operational phase has been reached, relative to a phase of said loom main shaft at loom starting, during operation of said fourth means.

2. A loom as claimed in claim 1, wherein said weft reservoir includes an engaging member which is operable at a predetermined timing to engage with the weft yarn to detain the weft yarn on said drum.

3. A loom as claimed in claim 1, wherein said clutch includes first and second members which are relatively movable to approach and separate from each other, and have opposing faces, respectively, said first member being formed at its face with a single depression, said second member being formed at its face with a single projection engageable with said first member depression.

4. A loom as claimed in claim 1, wherein said first means includes a first switch adapted to produce the signal when said clutch is disengaged.

5. A loom as claimed in claim 4, wherein said second means includes a second switch adapted to produce a signal when the phase of said weft reservoir reaches a predetermined angle.

6. A loom as claimed in claim 5, wherein said third means includes an electric motor, and an electromagnetic clutch for drivably connecting said motor with a weft reservoir, upon being engaged.

7. A loom as claimed in claim 6, wherein said fourth means includes a driver for causing said electromagnetic clutch to engage upon being operated, said driver being adapted to be operated for said predetermined time upon receiving the signals from said manually operated switch and said first switch.

8. A loom as claimed in claim 7, wherein said fifth means includes an air actuator having a piston rod connected to one of said clutch first and second members, said air actuator being so arranged that said piston rod moves in a direction to approach said clutch first and second members so as to engage said clutch when air supply thereto is stopped, and a solenoid valve through which air supply from a pressurized air supply source to said air actuator is stopped upon being closed, said solenoid valve being adapted to be closed upon receiving the signal from said second switch during operation of said driver.

9. A loom as claimed in claim 8, wherein said air actuator includes a spring for biasing said piston rod in said direction.

10. A loom as claimed in claim 1, wherein said weft reservoir includes a weft guide member whose tip end section is rotatable around said drum to wind said weft yarn on said drum which is substantially stationary.

11. A loom comprising:

a drum type weft reservoir having a drum, and means for winding a weft yarn on said drum when driven, to measure and reserve the weft yarn prior to weft picking;

a clutch through which said weft reservoir is drivably connected with a main shaft of the loom upon being engaged, said clutch being engageable at a predetermined operational phase of the loom;

first means for detecting the state of said clutch to produce a signal representative of a disengaged state of said clutch;

second means for detecting the operational phase of said weft reservoir to produce a signal;

third means for detecting the operational phase of said weft reservoir weft yarn winding means, upon being operated;

a manually operated switch for producing a signal commanding weft yarn winding on said weft reservoir drum, upon being operated;

fourth means for operating said third means for a predetermined time upon receiving the signal from said manually operated switched and the signal from said first means upon being operated; and fifth means responsive to the signal from said second means to change over said clutch into its engageable state at a second timing substantially later than a first timing at which said predetermined operational phase has been reached, relative to a phase of said loom main shaft at loom starting, during operation of said fourth means.

12. A loom comprising:

a drum type weft reservoir having a drum on which a weft yarn is wound to be measured and reserved prior to weft picking, upon said reservoir being driven;

a clutch through which said weft reservoir is drivably connected with a main shaft of the loom upon being engaged said clutch being engageable at a predetermined operational phase of the loom;

first means for detecting the state of said clutch to produce a signal representative of a disengaged state of said clutch;

second means for detecting the operational phase of said weft reservoir to produce a signal;

third means for driving said weft reservoir, upon being operated;

a manually operated switch for producing a signal commanding weft yarn winding on said weft reservoir drum, upon being operated;

fourth means for operating said third means for a predetermined time upon receiving the signal from said manually operated switch and the signal from said first means, upon being operated;

fifth means responsive to the signal from said second means to change over said clutch into its engageable state at a second timing substantially later than a first timing at which said predetermined operational phase has been reached, relative to a phase of said loom main shaft at loom starting, during operation of said fourth means; and sixth means for pulling said weft yarn in direction of a weft inserting nozzle during at least a part of a time in which said third means is operated.

* * * * *